US007097066B2

(12) United States Patent
Tucker et al.

(10) Patent No.: US 7,097,066 B2
(45) Date of Patent: Aug. 29, 2006

(54) PLATE CONTAINER WITH DETACHABLE COVER

(75) Inventors: Edward Tucker, Pleasanton, CA (US); Al Savicki, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 10/387,283

(22) Filed: Mar. 12, 2003

(65) Prior Publication Data

US 2003/0155354 A1 Aug. 21, 2003

Related U.S. Application Data

(63) Continuation-in-part of application No. 29/155,042, filed on Jan. 29, 2002, now abandoned.

(51) Int. Cl.
*B65D 41/16* (2006.01)

(52) U.S. Cl. ..... 220/780; 220/4.24; 220/380; 220/793; 206/508

(58) Field of Classification Search ..... 220/4.21, 220/4.24, 305, 380, 366.1, 367.1, 780–783, 220/785, 793, 796; 215/230; 206/503, 508; 229/406

See application file for complete search history.

(56) References Cited

U.S. PATENT DOCUMENTS 3,001,665 A * 9/1961 Tomarin ..... 220/4.21
3,401,825 A * 9/1968 Weiss ..... 220/787
3,412,888 A * 11/1968 Andrews et al. ..... 220/4.21
3,516,572 A 6/1970 Davis
3,643,830 A 2/1972 Kinney
3,653,830 A 2/1972 Kinney
3,773,207 A 11/1973 Dokouopil et al.
3,805,991 A 4/1974 Cheladze et al.
RE28,720 E * 2/1976 Sedlak ..... 229/406
3,938,726 A * 2/1976 Holden et al. ..... 229/406
4,051,951 A 10/1977 Smith
4,186,786 A 2/1980 Kirkpatrick
4,285,105 A 8/1981 Kirkpatrick
4,555,043 A * 11/1985 Bernhardt ..... 220/783
4,829,641 A 5/1989 Williams
4,907,321 A 3/1990 Williams
4,944,074 A 7/1990 Robson
5,070,584 A 12/1991 Dais et al.
5,138,750 A 8/1992 Gundlach et al.
5,140,727 A 8/1992 Dais et al.
5,154,086 A 10/1992 Porchia et al.
5,248,201 A 9/1993 Kettner et al.
5,252,281 A 10/1993 Kettner et al.
5,356,222 A 10/1994 Kettner et al.

(Continued)

FOREIGN PATENT DOCUMENTS

EP 0510797 10/1992

(Continued)

*Primary Examiner*—Nathan J. Newhouse
*Assistant Examiner*—James Smalley
(74) *Attorney, Agent, or Firm*—Thomas C. Feix; Ann Lee

(57) ABSTRACT

A plate container with detachable cover is disclosed. The container includes a base in the form of a plate and a cover. The plate and the cover include first and second closure portions, respectively, which are engageable with each other to maintain the cover in a secure position relative to the base and also forms a substantially leak-proof seal. The cover can include gripping tabs for facilitating the separation of the cover from the base and permit container venting. The plastic container is suited for microwave cooking, machine dishwashing, and freezer use.

29 Claims, 41 Drawing Sheets

U.S. PATENT DOCUMENTS

| | | | | |
|---|---|---|---|---|
| 5,363,540 | A | 11/1994 | Dais et al. | |
| 5,377,860 | A | 1/1995 | Littlejohn et al. | |
| 5,403,094 | A | 4/1995 | Tomic | |
| 5,427,266 | A | 6/1995 | Yun | |
| 5,553,701 | A * | 9/1996 | Jarecki et al. | 206/15.2 |
| 5,605,231 | A | 2/1997 | Borsboom | |
| 5,730,311 | A | 3/1998 | Curtis | |
| 5,979,690 | A | 11/1999 | Hartley | |
| 6,152,318 | A | 11/2000 | Walker | |
| 6,152,328 | A | 11/2000 | Walker | |
| 6,164,484 | A | 12/2000 | Flore et al. | |
| 6,168,044 | B1 | 1/2001 | Zettle et al. | |
| 6,170,696 | B1 | 1/2001 | Tucker et al. | |
| 6,467,647 | B1 * | 10/2002 | Tucker et al. | 220/793 |
| 2002/0148845 | A1 | 10/2002 | Zettle et al. | |

FOREIGN PATENT DOCUMENTS

| | | |
|---|---|---|
| EP | 0434447 | 5/1995 |
| JP | 9-2539 | 6/1994 |
| JP | 9-2539 | 9/1997 |
| WO | 01/0730 | 2/2001 |
| WO | 01/10730 | 2/2001 |

* cited by examiner

PLATE CONTAINER WITH DETACHABLE COVER

CROSS-REFERENCE TO RELATED PATENT APPLICATIONS

This patent application is a continuation-in-part of U.S. patent application No. 29/155,042, now abandoned, filed Jan. 29, 2002, and entitled "Plate Container With Detachable Cover," which is incorporated in its entirety herein by this reference.

FIELD OF THE INVENTION

This invention pertains to sealing containers, and more particularly to a plate container with a detachable cover.

BACKGROUND OF THE INVENTION

Rigid thermoplastic food containers may be classified into two distinct categories. The first category of container is the containers that the consumer acquires during the purchase of dairy or deli foods at a retail store. This type of container is often referred to as an "inexpensive" container since usually the consumer's intention is to purchase the food in the container irrespective of the type of container. Since the consumer pays the retail price necessary to purchase the food, they often think of the container as an inexpensive item which they may save for re-use at a later date.

With respect to this first type of container, a group includes the inexpensive convenience containers which consumers frequently acquire when purchasing deli foods. Generally, these "deli" containers need only to perform the function of providing a highly visible display and to provide containment of solid foods, such as, bakery items, salads or fruit at refrigeration temperature to ambient temperature. Often, the material of choice is a high clarity grade of APET (amorphous polyethylene terephthalate) or PS (polystyrene) and the containers are manufactured into many shapes by a thermoforming process so as to provide wall thicknesses of about 0.010–0.020 inches. This wall thickness range represents the low end of wall thicknesses generally seen in rigid thermoplastic food containers and as a consequence the containers can be made very inexpensively. Thus, the consumer may deem the container disposable, i.e. discardable without significant monetary loss that can be attributed to the cost of acquiring the container. In addition, the weight to volume ratio (i.e. the weight of the container over the volume of the container) of these containers is approximately 33.8–37.2 grams/liter for the total of the top and bottom of the container.

Since these deli containers have no elevated temperature requirements and thus can be formed from APET or PS, their low heat distortion temperature makes them highly unsuitable for microwave cooking applications. Furthermore, because the containers are not designed to provide a secure seal for liquid foods, the containers may leak if inverted while attempting to contain such foods during re-use by the consumer. Also, because the materials of construction are generally brittle, these containers will generally crack if stressed mechanically and thus are not very durable.

"Dairy" containers also represent another group of thermoplastic containers that can be characterized as "inexpensive." These containers are designed to hold butters, fresh and processed cheeses, yogurts, and ready-serve sauces at retail. Often a food producer fills these containers while the food contents are hot enough to flow freely into the container. In these cases, the materials of choice for such containers are generally PP (polypropylene) or HDPE (high density polyethylene) owing to their elevated temperature performance characteristics. The container bottoms are manufactured by an injection molding or thermoforming process. The container bottoms made by injection molding have a wall thickness of about 0.020–0.040 inches. The container bottoms made by thermoforming have a wall thickness of about 0.010–0.020 inches. Like the "deli" containers, the "dairy" containers can be made very inexpensively and as such the consumer may deem the container disposable after limited re-use. The weight to volume ratio of the injection molded containers is approximately 43.9–57.4 grams/liter for the total of the top and bottom of the container. The weight to volume ratio of the thermoformed containers is approximately 37.2–54.1 grams/liter for the total of the top and bottom of the container.

Also the dairy containers should prevent moisture loss, oxygen permeation, and odor absorption which if not prevented would undesirably alter the food contents. The food producer solves these problems by completely enclosing the head space above the food by application of a lidding material, such as, foil or thermoplastic barrier film which is continuously sealed to the upper lip of the container bottom. The container generally will also include a removable rigid thermoplastic lid that is placed over the continuously sealed lidding foil or film so that puncture protection is provided. The lid has a wall thickness of about 0.010–0.020 inches. The rigid thermoplastic container lid usually engages the container bottom so as to provide a crude fit, but it does not have to provide a secure leakproof seal since the lidding material accomplishes this function. Thus when the consumer goes to re-use the container, they may find that the container's seal is unsuitable for rough transport and handling of liquid foods, since the lidding material has been peeled off during consumption of the original contents and only the crude fitting rigid lid remains.

The lid is usually made from a softer polyethylene material which often does not have the same heat resistance of the container bottom. Thus, when the consumer goes to re-use the container, they may find that the lid is easily distorted during microwave heating.

Finally, the dairy container materials are usually highly pigmented to provide opacity in order to prevent light-induced oxidation of fat-containing dairy products so as to extend store shelf life. The consumer may prefer a see-through container which allows easy recognition of food contents during re-use of the container. Thus, dairy containers would be unsuitable in this regard.

Although these deli and dairy containers are inexpensive, their lack of heat resistance and poor sealing characteristics severally limit their use.

For example, many consumers choose to take their lunch to work. While in transit, containers are frequently resting on uneven surfaces or being jostled from ordinary movements, and as a result, the contents of an inexpensive container may leak onto clothing, upholstery, and/or other food. In addition, the inexpensive containers may not be suitable for microwave use, and the food must be removed from the container and placed on dishware suitable for microwave cooking before being heated.

The second category of food containers consists of expensive durable containers which may utilize more expensive plastic materials and thick container walls. These containers address the shortcomings of the inexpensive containers in that they may be suitable for microwave, dishwasher, and freezer use and provide a secure seal which will not leak.

However, these containers may employ costly materials. In addition, due to their sophisticated design elements, these containers generally require heavier construction to enable manufacture within the limitations associated with the injection molding process from which these containers are made. These containers have wall thicknesses of about 0.020–0.080 inches. Thus, this second category of containers becomes too expensive for disposable use. As a result, a consumer taking his or her lunch to work in an expensive durable container must be burdened with also transporting the container from work to home. The weight to volume ratio of these containers is approximately 67.6–219.6 grams/liter for the total of the top and bottom of the container.

Furthermore, when a food container is used to transport food for consumption at another location, for example when a consumer takes his or her lunch to work, the consumer is required either to eat the food directly from the container or to make arrangements for having a suitable serving dish available at the other location. In the former case, the consumer may find the notion of eating the food directly from the container unappetizing, thereby reducing the usefulness of the container as a storage device. In the latter case, the consumer is subjected to further inconvenience and/or expense by having to ensure that a suitable serving dish is on hand.

SUMMARY OF THE INVENTION

The invention provides a container that can be readily manufactured, for example, with conventional thermoforming equipment. The container includes a plate-like container base having a first closure portion and a plate-like cover having a second closure portion. The closure portions of the cover and the base can be engaged with each other to provide a leak-proof, re-sealable closure.

When the first and second closure portions are occluded, the base and the cover define a substantially sealed storage area. The closure portions can be configured to permit the venting of the container during occlusion of the cover to the base and microwave reheating of food, for example. The cover can include a raised dome to increase the capacity of the storage area. Advantageously, the cover can be removed from the base and inverted for use as a plate. The cover can include a gripping tab for facilitating the removal of the cover from the container base.

Each closure portion includes a sealing surface, which can be, for example, molded during a thermoforming process such that the sealing surface does not contact the mold tool surface during manufacture to facilitate the production thereof.

The present invention provides a reusable, tight sealing container available to a consumer at a price appropriate for disposable use. The cover can be made from a semitransparent material to ensure satisfactory visibility of the container contents. The container can be suitable for microwave and machine dishwasher use. The closure portions can be configured such that the container maintains its sealing characteristics while in freezer type temperatures.

The cover of the container can be stacked in a nested arrangement with other covers. The container base can be stacked in a nested arrangement with other container bottoms. The cover can be stacked in a nested arrangement with the container base wherein the cover is in an inverted position. A first container can be stacked upon a second container.

Advantageously, the container can function to store materials and also to act as a plate or as a pair of plates for serving food, for example.

These and other features of the present invention will become apparent to one of ordinary skill in the art upon reading the detailed description, in conjunction with the accompanying drawings, provided herein.

DETAILED DESCRIPTION OF EMBODIMENTS OF THE INVENTION

Figure 1:
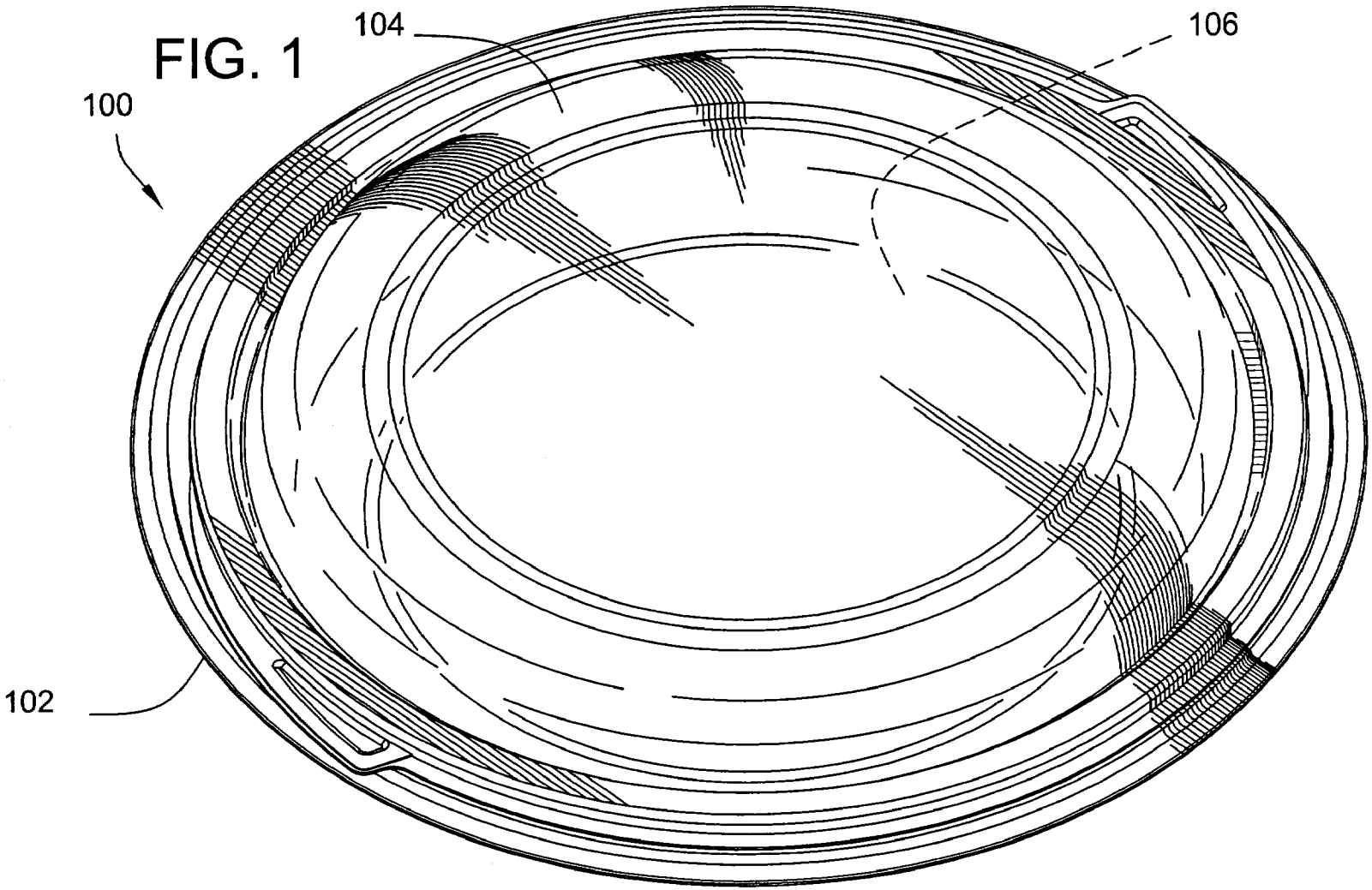
FIG. 1 is a top perspective view of a container for food according to the present invention.
Figure 2:
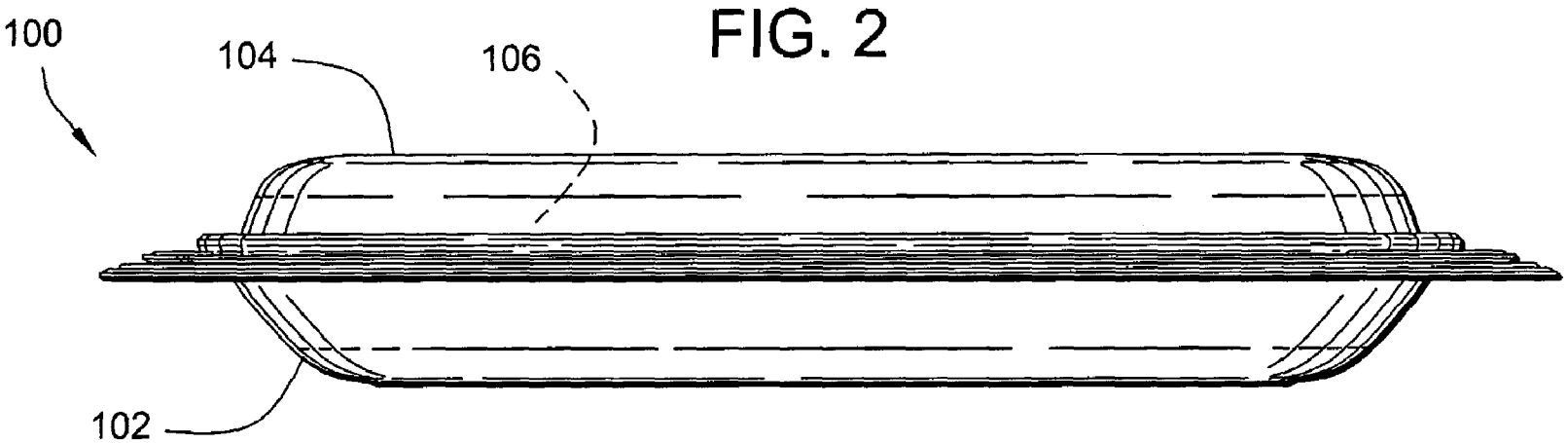
FIG. 2 is a front elevational view of the container of FIG. 1.
Figure 3:
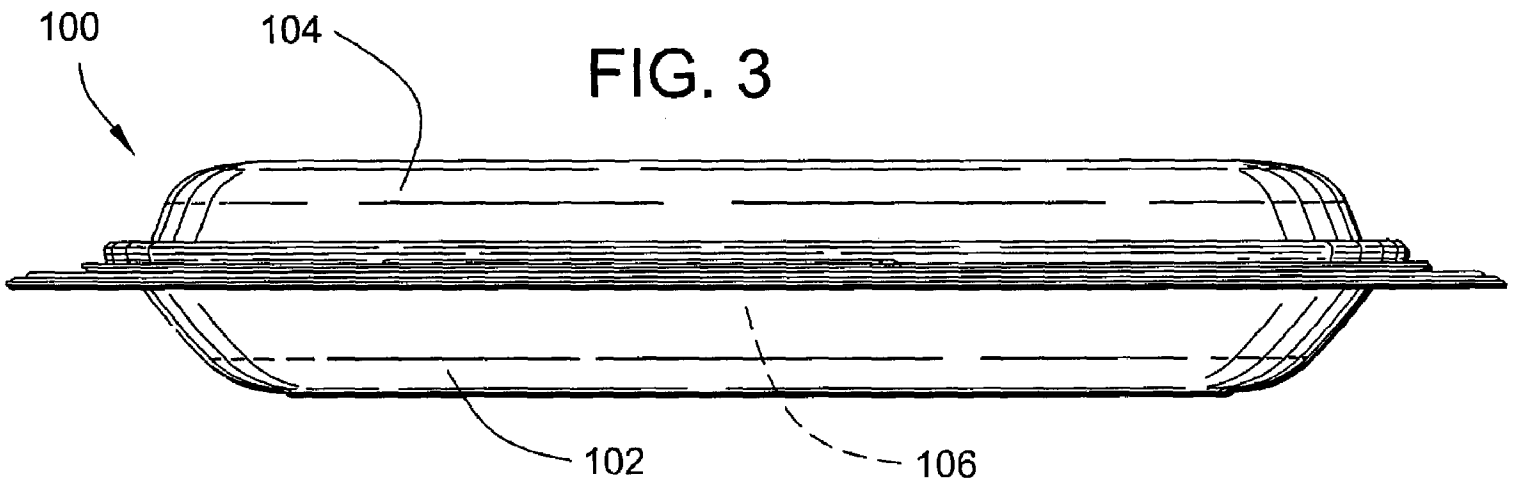
FIG. 3 is a right side elevational view of the container of FIG. 1.

Turning now to the drawings, there is shown in FIG. 1 an illustrative container 100 constructed in accordance with the present invention. Referring to FIGS. 1–6, in this embodiment, the container 100 includes a flexible plastic base 102 which is sealingly closed by a flexible plastic cover 104 to define a storage area 106.

The base 102 has a plate-like configuration, and the cover 104 has a similar shape. The cover 104 can be removed from the base 102 and inverted for use as a serving dish. Advantageously, the container 100 can function to store materials and also to act as a plate or as a pair of plates for serving food, for example. The cover also conveniently can act to prevent splatter of contents during microwave re-heating of food.

Figure 6:
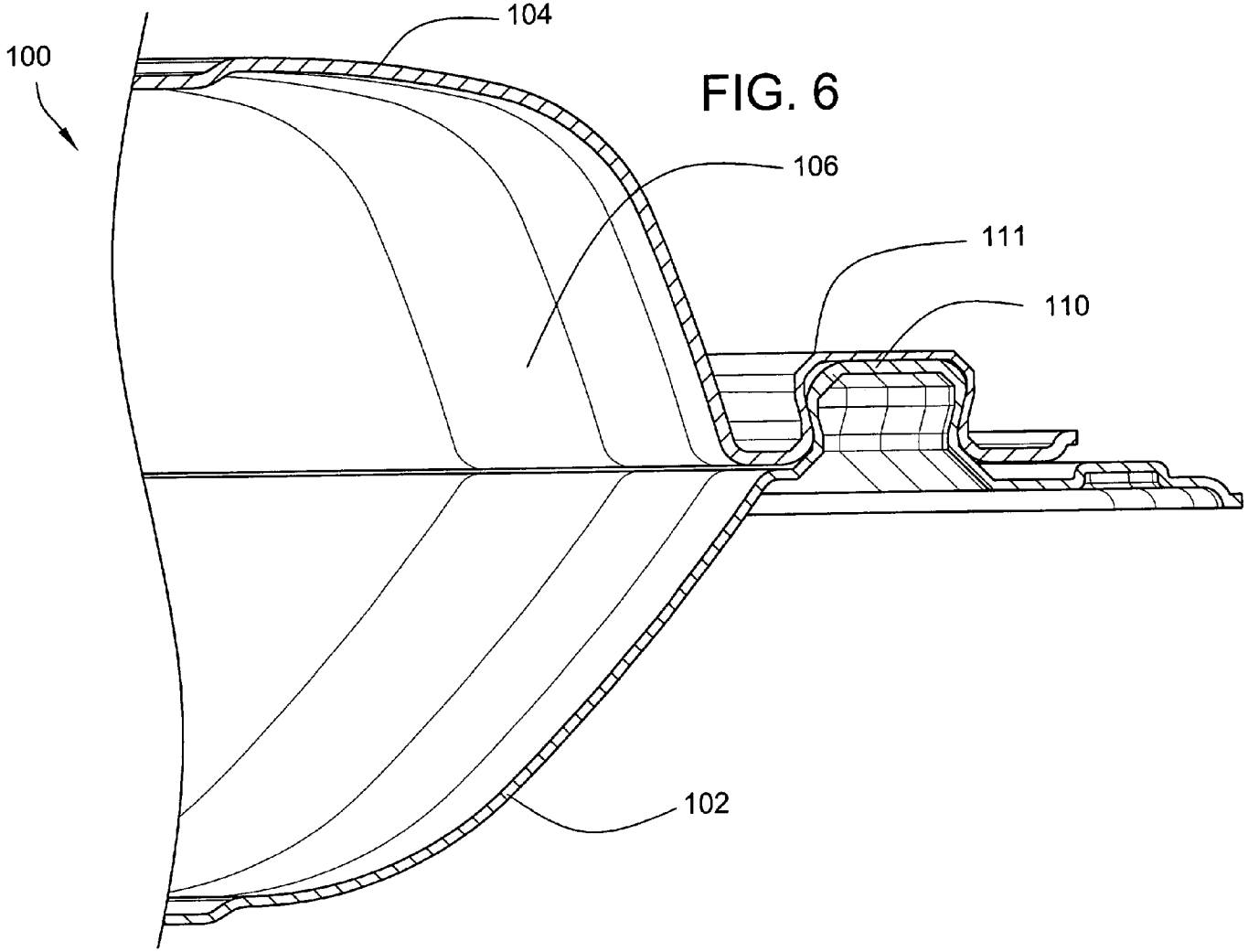
FIG. 6 is a cross-sectional view taken along line 6—6 in FIG. 4.

Referring to FIG. 6, the base 102 includes a first closure portion 110 in the form of a raised locking ring. The cover 104 includes a second closure portion 111 in the form of a raised locking ring. The first and second closure portions 110, 111 can be engaged with each other to provide a leak-resistant, re-sealable closure to occlude the base 102 and the cover 104. The first and second closure portions 110, 111 can be occluded to seal the container 100 by pinching the first and second locking rings between a user's fingers, for example. The container can be reusable.

Referring to FIGS. 7–12, the base 102 is shown. The base 102 is a relatively shallow, flat-bottomed receptacle suitable for holding and serving food. The base 102 includes a generally planar bottom portion 120 and a curved sidewall portion 122 extending around the bottom. The sidewall 122 is generally curved and extends upwardly and outwardly from the periphery of the bottom 120. In other embodiments, the sidewall 122 may have a constant wall draft or may include a combination of arcs and linear segments with or without points of inflection.

Figure 7:
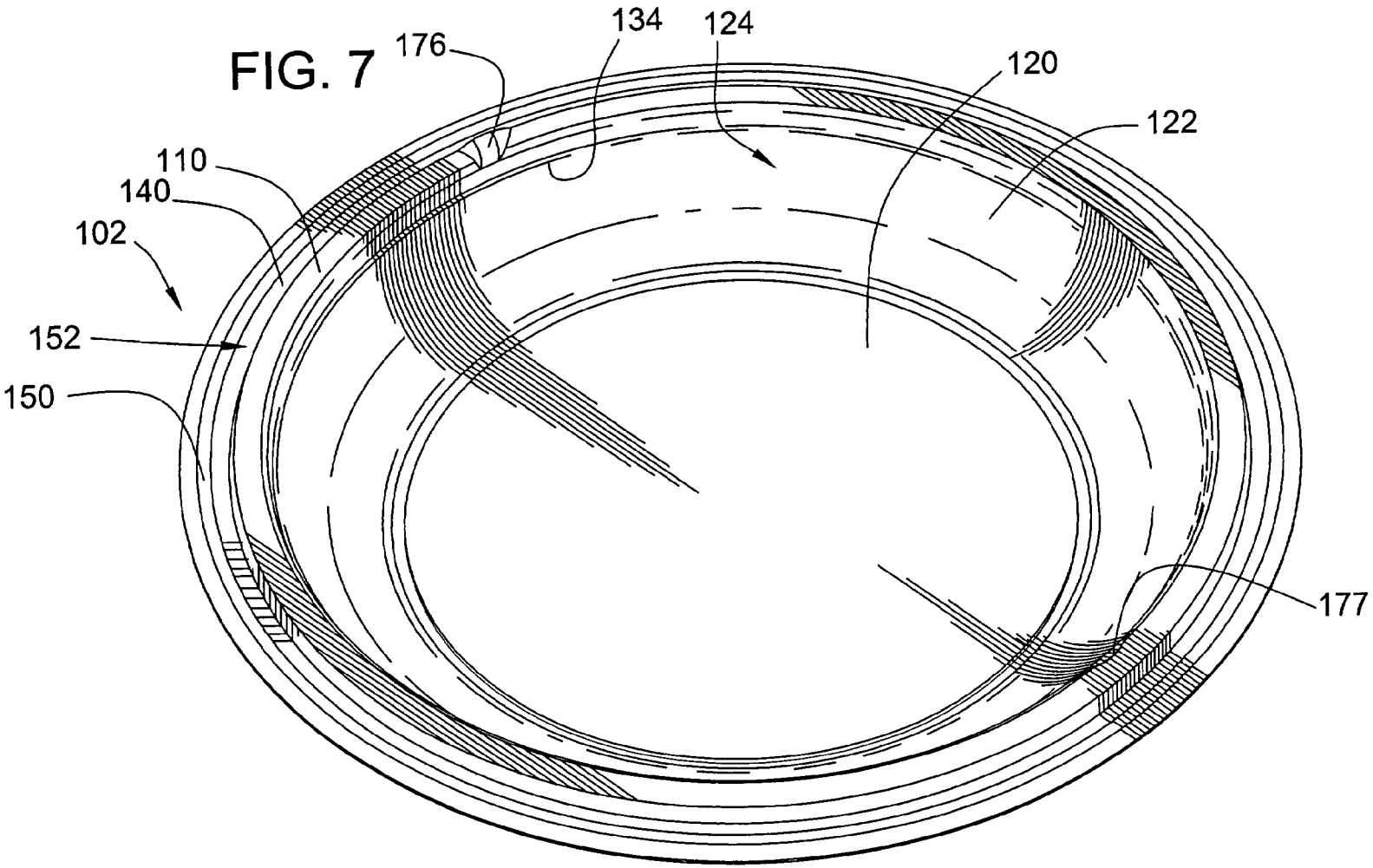
FIG. 7 is a top perspective view of a base of the container of FIG. 1.
Figure 9:
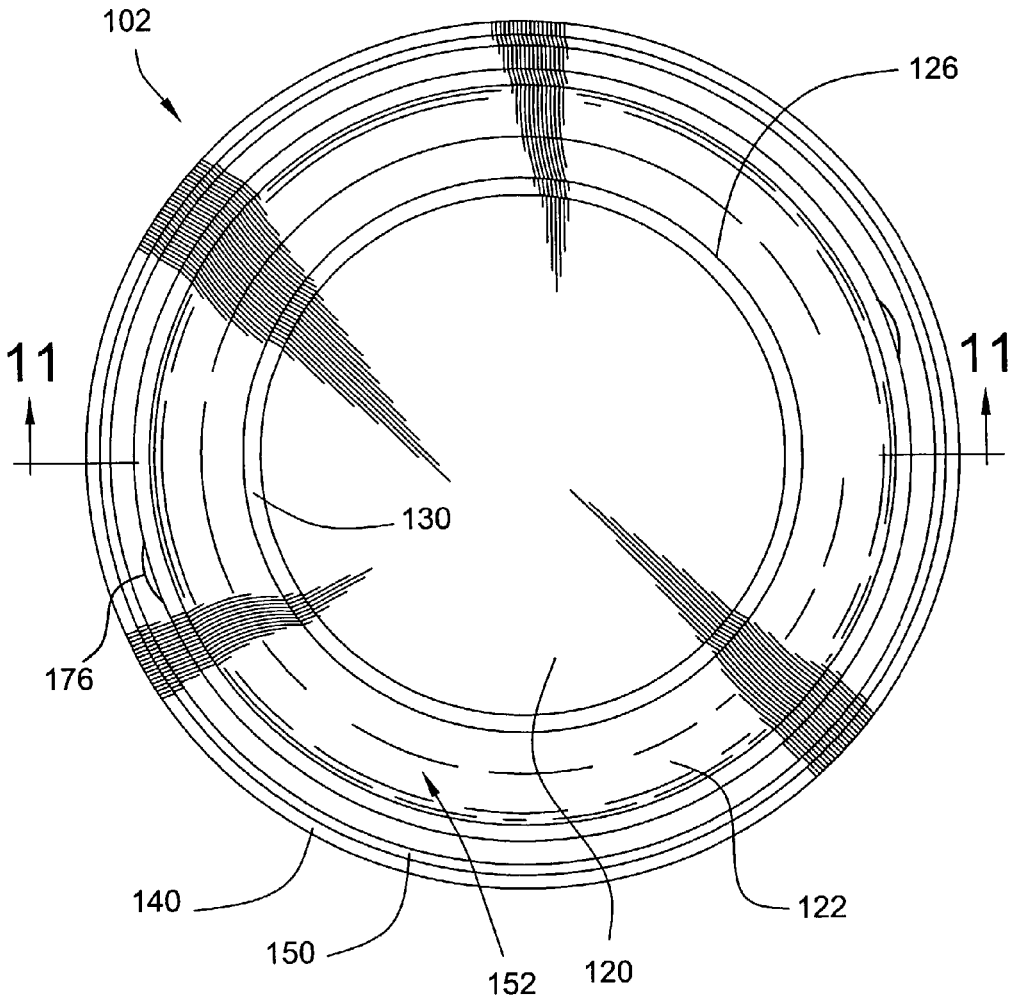
FIG. 9 is a top plan view of the base of FIG. 7.
Figure 10:
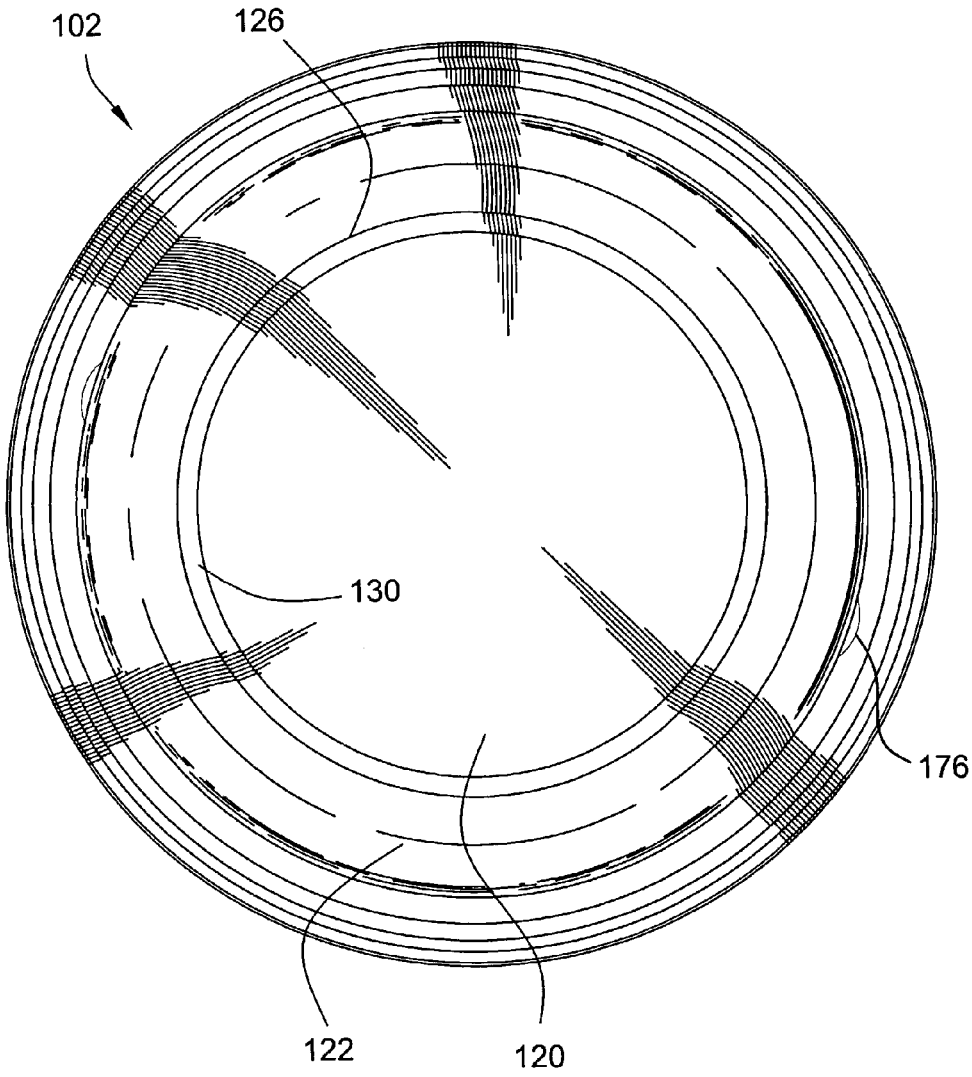
FIG. 10 is a bottom plan view of the base of FIG. 7.
Figure 11:
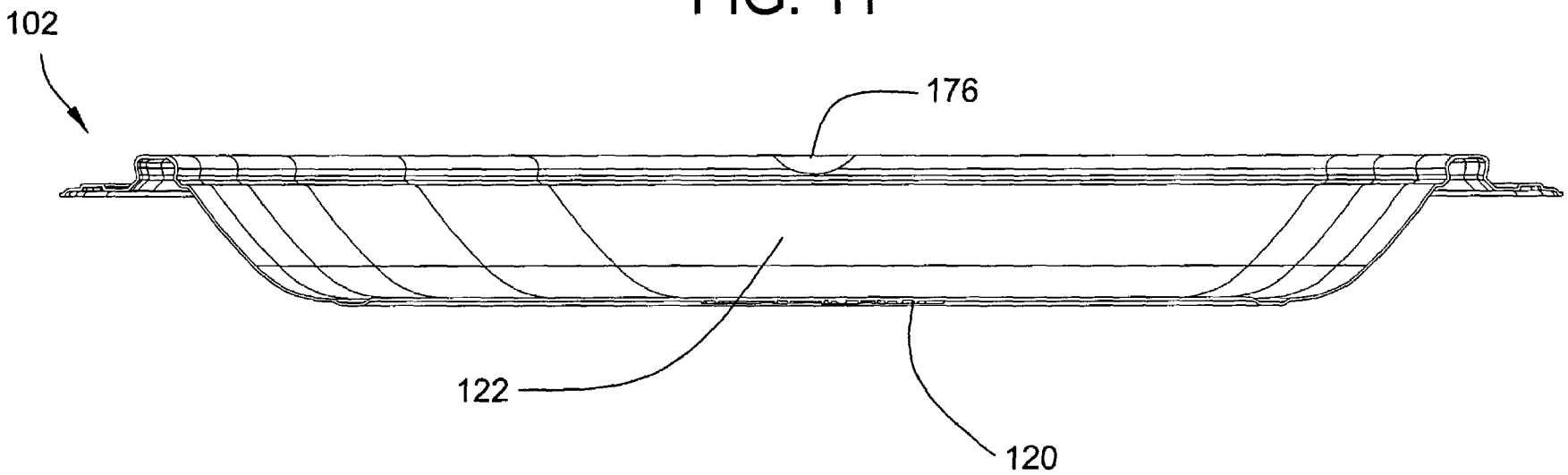
FIG. 11 is a cross-sectional view taken along line 11—11 in FIG. 9.

Referring to FIG. 7, the bottom 120 and the sidewall 122 define an interior cavity 124. Referring to FIGS. 9 and 10, the bottom 120 is substantially circular, having a perimeter 126 in the form of a circumference. In other embodiments, the bottom 120 can have other shapes, such as, rectangular, for example. The bottom 120 can include an embossed area or receive a label, a sticker, or other display means for bearing indicia. The base 102 includes a first stacking element 130 in the form of a ring which coincides with the circumference 126 of the bottom 120 and extends from an exterior surface 132 of the base 102, as shown in FIG. 12.

Figure 8:
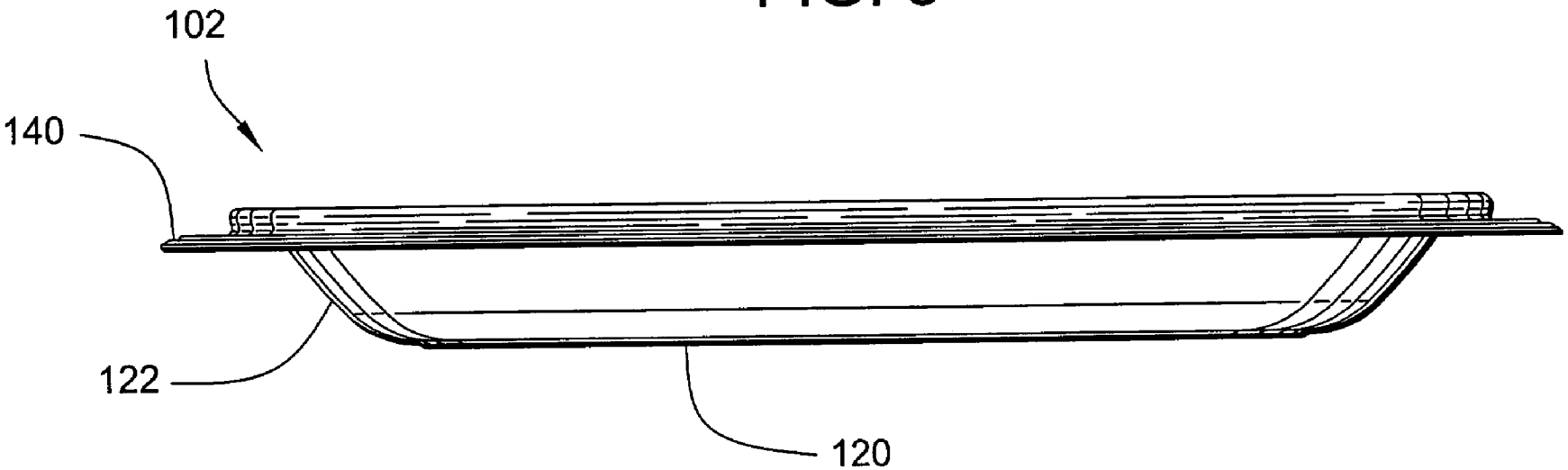
FIG. 8 is a front elevational view of the base of FIG. 7.

Referring to FIG. 7, the first closure portion 110 is in the form of a raised locking ring that extends around an upper edge 134 of the sidewall 122. The base 102 includes a flange 140 which extends outwardly from the first closure portion 110, extending therearound, as also shown in FIGS. 8 and 9.

Figure 12:
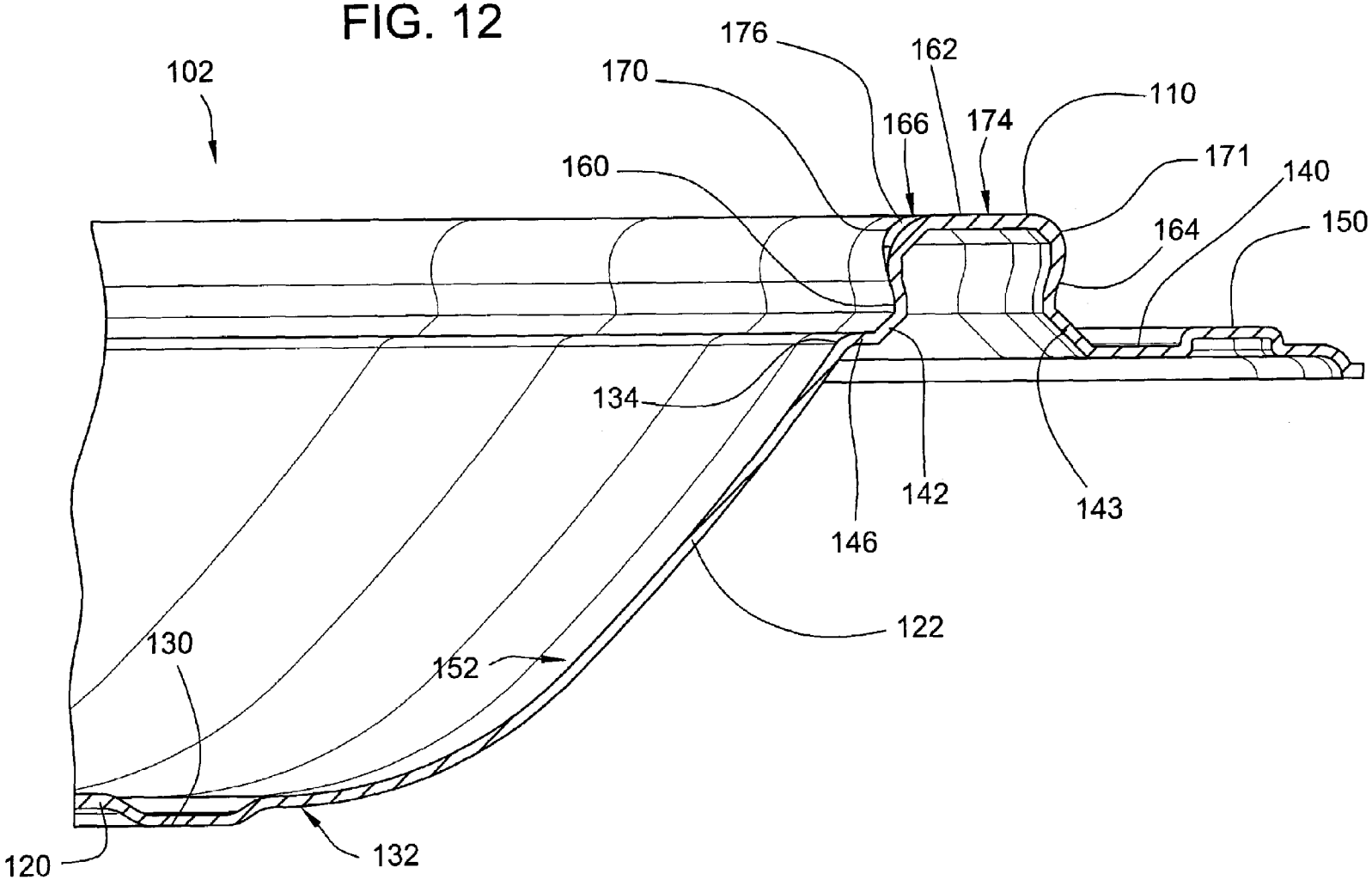
FIG. 12 is an enlarged, detail view taken from FIG. 11.

Referring to FIG. 12, the base 102 can include a pair of nest lugs 142, 143 which are disposed in opposing relation to each other, flanking the first closure portion 110. The nest lugs 142, 143 can facilitate the nesting of a plurality of bases to form a vertical stack convenient for the commercial handling and packaging thereof.

The base includes a shoulder 146 which is disposed between the first nest lug 142 and the upper edge 134 of the sidewall 122. The shoulder 146 is substantially parallel to the bottom portion 120 of the base 102. The shoulder 146 can extend around the entire sidewall at the upper edge 134. The first nest lug 142 extends from the shoulder 146 at an oblique angle thereto. The first nest lug 142 merges into the first closure portion 110. The second nest lug 143 can extend outwardly from the first closure portion 110, extending between the first closure portion and the flange 140.

The flange 140 can provide a convenient gripping surface to facilitate the occlusion of the cover and the bottom and the removal of the cover from the bottom. The flange can further enhance the plate-like appearance of the bottom. The flange 140 can include a raised ring 150 extending from an interior surface 152 of the base 102, as also shown in FIGS. 7 and 9. The raised ring 150 adds rigidity to the flange 140. The raised ring 150 also provides a frictional gripping surface to reduce slippage when grasping the flange 140. In other embodiments, rigidifying and gripping structures can be provided to the surface of the flange 140 that are continuous or intermittent rib patterns, or other decorative shapes.

Referring to FIG. 12, the first closure portion 110 includes an inner wall 160, a retention bead 162, and an outer wall 164. The inner wall 160, the retention bead 162 and the outer wall 164 define a first sealing surface 166, which is part of the interior surface 152 of the base 102. The inner wall 160 extends from the first nest lug 142 and merges into the retention bead 162. The retention bead 162 can include a pair of rounded shoulders 170, 171 and a crown surface 174. The outer wall 164 joins the retention bead 162 and the second nest lug 143. The inner and outer walls 160, 164 converge toward each other from the retention bead 162 toward the first and the second nest lugs 142, 143, respectively, and in doing so provide inside and outside cut back portions.

One of the first and the second closure portions can include at least one notch that defines an air passageway between the base and the cover when the closure portions of the base and the cover undergo an occlusion sequence. In this embodiment, the first rounded shoulder 170 of the retention bead 162 includes a pair of notches 176 and 177, also shown in FIGS. 7 and 11. For ease of description, only one notch 176 will be described herein. It will be understood that the description of the one notch 176 is applicable to the other notch 177, as well. The notch 176 can define an air passageway during the occlusion of the first and second closure portions to permit venting of the container. The air passageway can permit the container to be vented during the occlusion of the closure portions for sealing the cover 104 to the base 102. The venting feature can be advantageous since it is desirable to expel air upon closing the container to prevent untoward bulging of the container by trapped air and to reduce the amount of air in the headspace of the container since this air may negatively affect the quality of the stored food contents. The air passageway can be sealed to prevent air from passing therethrough when the closure portions are fully occluded. A seal can be formed between the first and second closure portions such that the container is substantially leak resistant.

In this embodiment, as shown in FIG. 12, the notch 176 is located at the first shoulder 170 adjacent the top of the inner wall 160. The notch 176 is disposed between the inner walls 160 and the outer wall 164 of the closure portion 110. The notch 176 is in the form of a discrete, depression-like channel that extends over at least a portion of the total width of the first closure portion 110, measured from the inner wall 160 to the outer wall 164.

The base 102 has a sufficient thickness to withstand the heat of microwave cooking and remain sturdy during lifting while laden with hot food and also withstand the heat of top-shelf dishwashing without deforming.

Referring to FIGS. 13–20, the cover 104 is shown. The cover 104 includes an interior surface 190 and an exterior surface 191. The cover 104 can include a raised dome 194 to increase the size of the storage area and/or to allow the user to create a vacuum in the container upon sealing. For example, in order to create a vacuum, the user can depress the dome during the closing of the container. A return force imparted upon the dome generated by the inherent resiliency of the material of the cover will urge the dome to return to its normal position, creating a vacuum.

Figure 13:
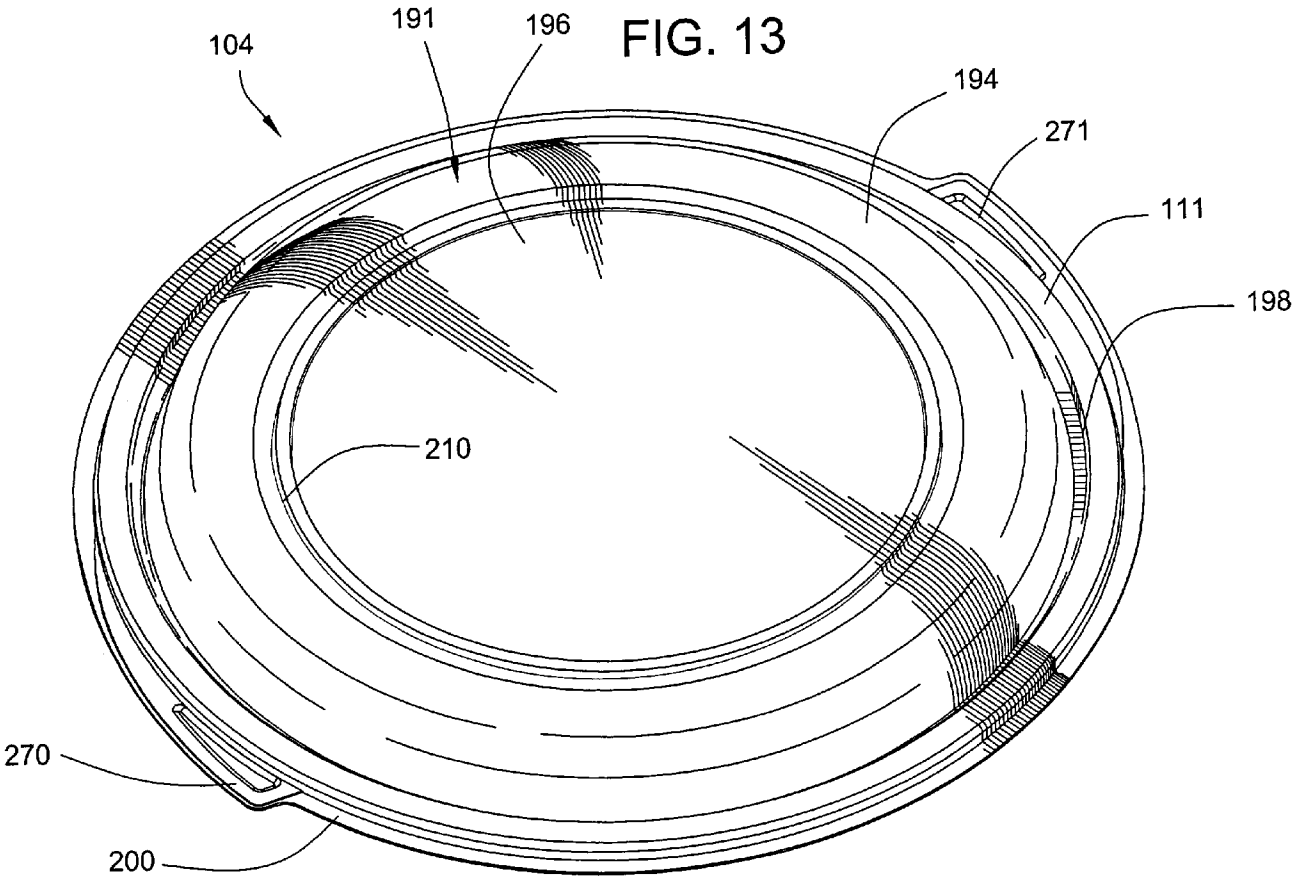
FIG. 13 is a top perspective view of a cover of the container of FIG. 1.

Referring to FIG. 13, the dome 194 includes a central, field portion 196 that is generally circular. In other embodiments, the field portion 196 can be other shapes, for example rectangular or elliptical. The central field portion 196 is configured such that it can include an embossed area or receive a label, a sticker, or other display means for bearing indicia.

Figure 18:
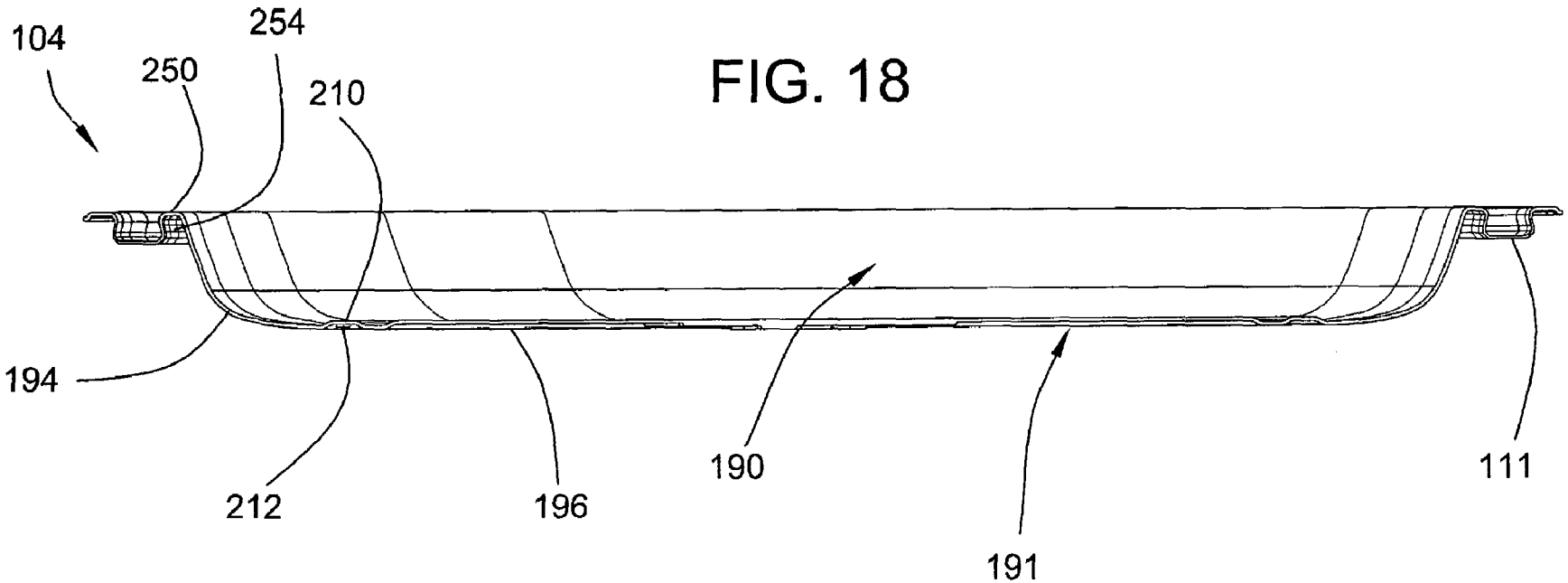
FIG. 18 is a cross-sectional view taken along line 18—18 in FIG. 17.

The second closure portion 111 can extend from the exterior surface 191, extending around a perimeter 198 of the dome. A generally planar flange 200, also shown in FIGS. 14 and 15 can extend from the second closure portion 111. A second stacking element 210 extends around the periphery of the central field portion 196. Referring to FIG. 18, the second stacking element 210 extends from the interior surface 190 of the cover 104 to define a groove 212 in the exterior surface 191.

Figure 19:
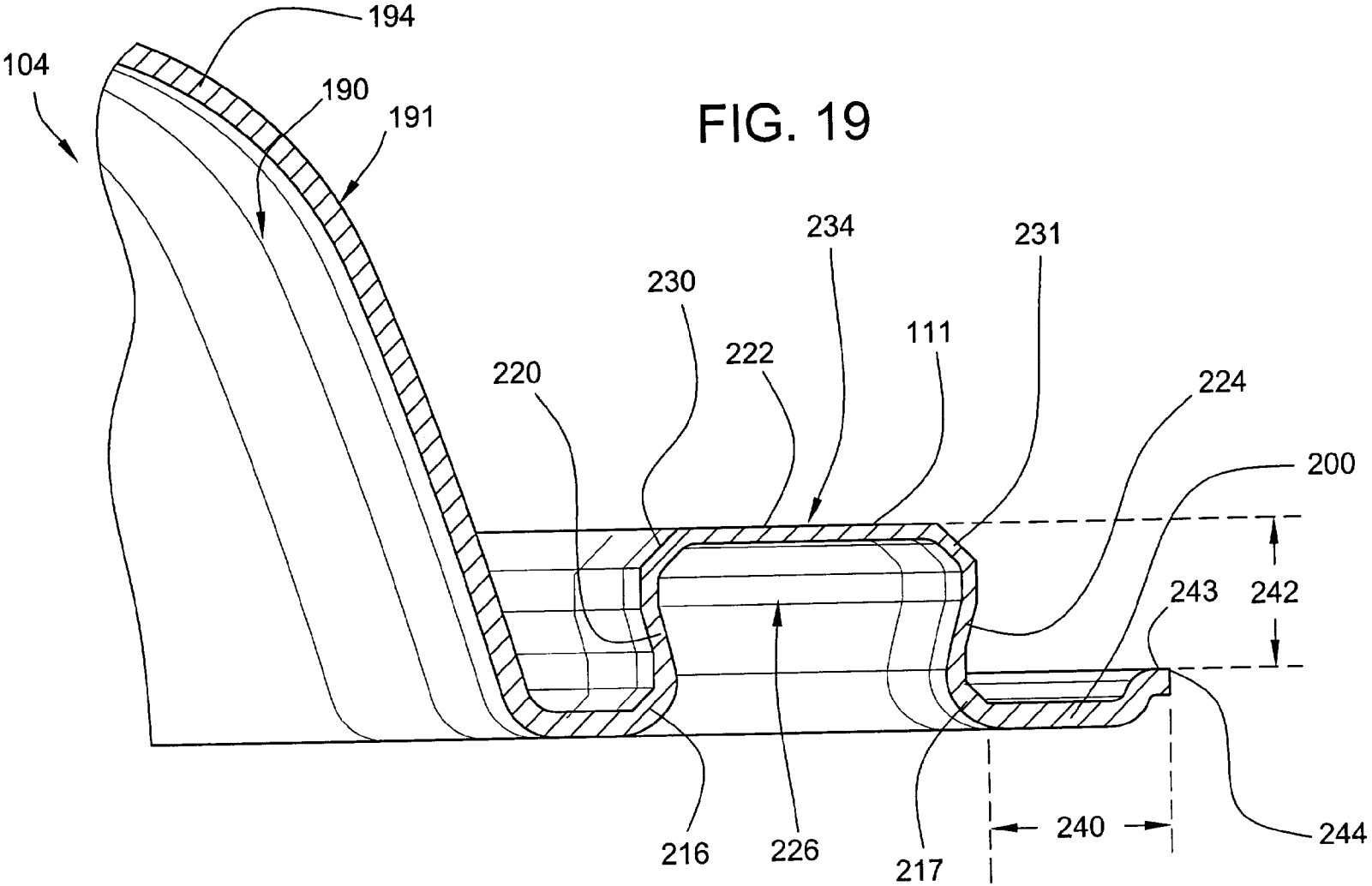
FIG. 19 is an enlarged, cross-sectional view taken along line 19—19 in FIG. 16.

Referring to FIG. 19, the cover 104 can include a pair of nest lugs, 216, 217 flanking the second closure portion 111. The nest lugs 216, 217 are disposed in opposing relationship to each other and can be configured to allow the nesting of a plurality of covers in a vertical stack convenient for the commercial handling and packaging thereof.

The second closure portion 111 is similar to the first closure portion. The second closure portion 111 includes an inner wall 220, a retention bead 222, and an outer wall 224. The inner wall 220, the retention bead 222, and the outer wall 224 define a second sealing surface 226, which is a part of the interior surface 190 of the cover 104. The inner wall 220 extends from the first nest lug 216 and merges into the retention bead 222. The retention bead 222 can include a pair of shoulders 230, 231 and a crown surface 234. The outer wall 224 joins the retention bead 222 and the second nest lug 217. The inner and outer walls 220, 224 converge toward each other from the retention bead 222 toward the first and the second nest lugs 216, 217, respectively, and in doing so provide inside and outside cut back portions.

The second nest lug 217 can extend outwardly from the outer wall 224 of the second closure portion 111, extending between the second closure portion 111 and the flange 200.

Referring to FIG. 19, to facilitate the manufacture of the cover, the flange 200 can extend a distance 240 at least equal to one-half of a height 242 of the second closure portion 111, measured from the top surface 243 adjacent to the trim edge 244 to the crown surface 234, to promote proper pilot configuration for a punch-and-die trimming operation, for example.

Figure 20:
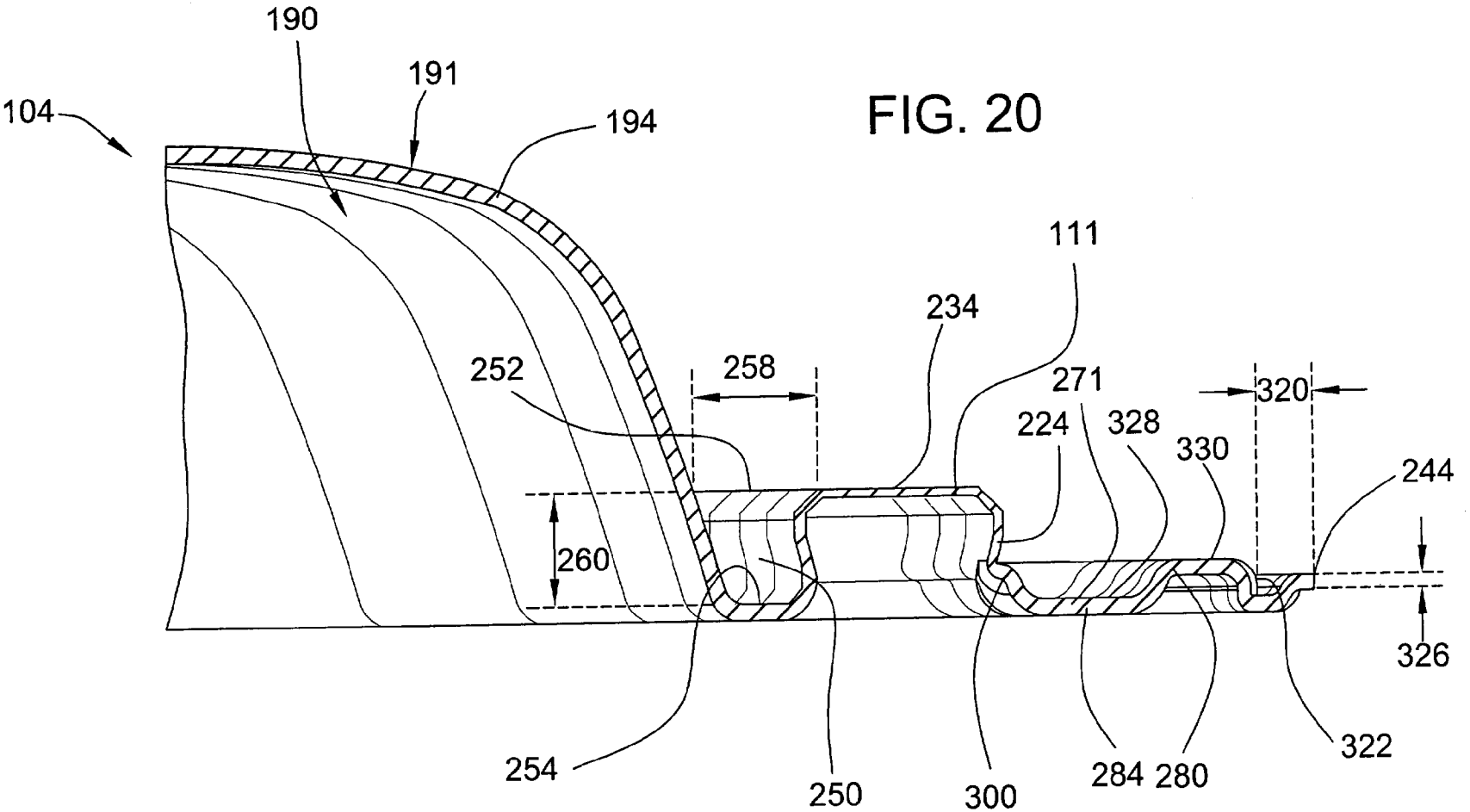
FIG. 20 is an enlarged, cross-sectional view taken along the line 20—20 in FIG. 16.

Referring to FIG. 20, the second closure portion 111 and the raised dome 194 define a channel 250 therebetween. The channel 250 includes an open mouth 252 and a closed end 254. The mouth 252 is aligned with the crown surface 234 of the second closure portion 111. The channel 250 can have a width 258, measured between the dome 194 and the second closure portion 111 along the mouth 252. The channel 250 can have a predetermined depth 260, measured between the open mouth 258 and the closed end 254. In one embodiment, the width 258 can be less than twice the depth 260 of the channel 250. In other embodiments, the width 258 of the channel 250 can be less than the depth 260 of the channel 250.

The closed end 254 of the channel 250 is substantially parallel to the field portion 196 of the cover 104, as shown in FIG. 18. The channel 250 can extend around the entire perimeter of the dome 194. The first nest lug 216 extends from the closed end 254 of the channel 250 at an oblique angle thereto.

Figure 14:
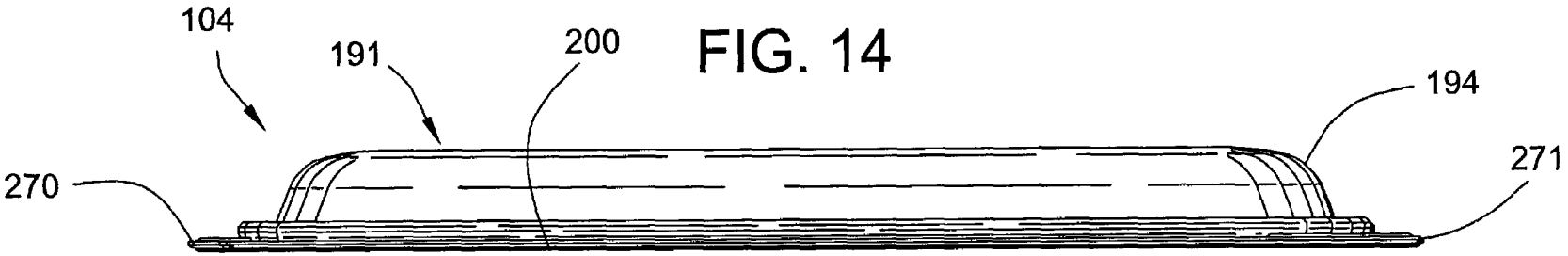
FIG. 14 is a front elevational view of the cover of FIG. 13.
Figure 15:
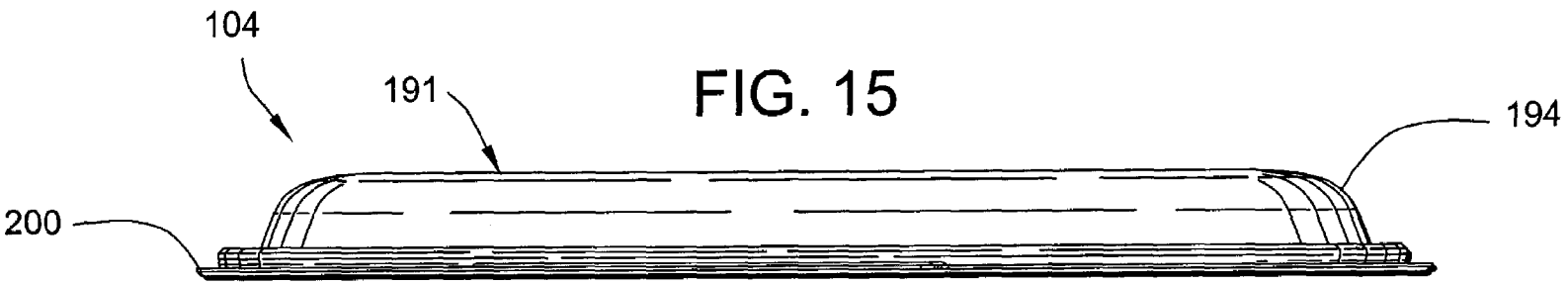
FIG. 15 is a right side elevational view of the cover of FIG. 13.

Referring to FIG. 13, the cover 104 can include at least one gripping tab adjacent the second closure portion 111 to facilitate removal of the cover from the base. The cover 104 includes a pair of gripping tabs 270, 271. The gripping tabs 270, 271 are disposed in opposing relationship to each other, extending from the second closure portion 111 and the flange 200. The gripping tabs 270, 271 are integral with the flange 200. Referring to FIG. 14, the gripping tabs 270, 271 extend outwardly from the flange 200.

Figure 16:
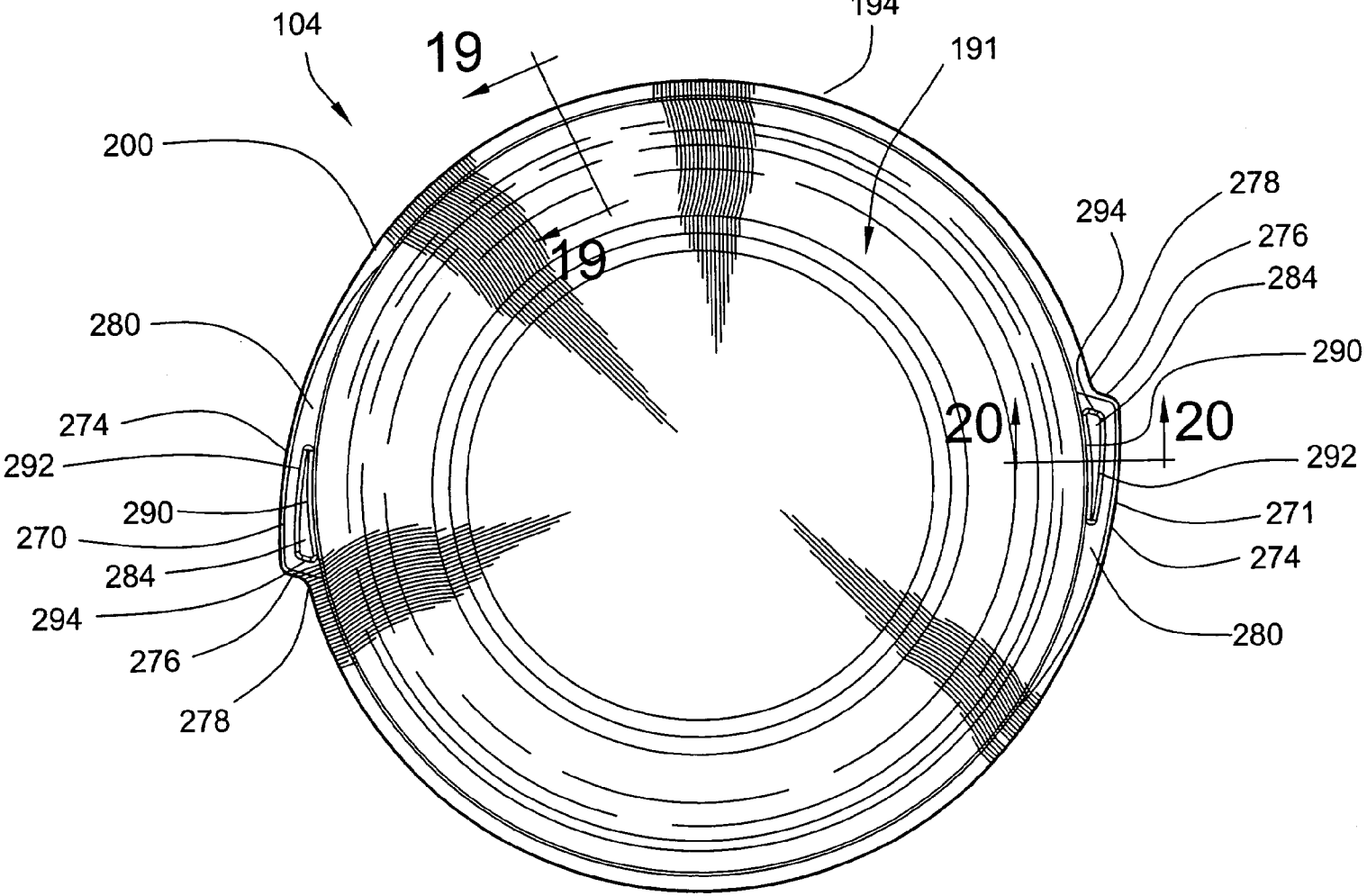
FIG. 16 is a top plan view of the cover of FIG. 13.

Referring to FIG. 16, each gripping tab 270, 271 includes a curved outer edge 274 and a shoulder portion 276 that defines a notch 278. Each gripping tab 270, 271 includes a raised rib 280 that generally conforms to the periphery of the flange 200. The rib 280 extends outwardly from the second closure portion 111. The rib 280 defines an indented portion 284 that is contained within the rib 280. The indented portion 284 has a closure portion side 290, an outer side 292, and a shoulder side 294, which, seen from a top plan view, substantially correspond to the shape of the second closure portion 111, the outer edge 274 of the gripping tab, and the shoulder 276 of the gripping tab, respectively. In other embodiments, the gripping tabs 270, 271 may have other shapes as seen from a top plan view. For example, the shape can be elliptical, oblong, ovate, or dog-eared, or the shape can be composed of longitudinal edges that are concentric with the shape of the cover.

The rib 280 and indented portion 284 have a reinforcing and stiffening effect which provide a means of leverage in separating the cover from the base. The rib 280 and the indented portion 284 can further provide a frictional gripping surface to minimize slippage when grasping the respective tab 270, 271.

In other embodiments, the gripping tab may also include one or more cross-ribs or a textured surface to improve the grip on the tab.

Referring to FIG. 20, the tab 271 includes a relieved portion 300 adjacent the outer wall 224 of the second closure portion 111. As a result, the relieved portion provides less interference contact with the base during the removal or engagement of the cover 104 while still providing an adequate closure portion to maintain proper sealing of the closure device. The raised rib 280 defines the relieved portion 300.

Figure 4:
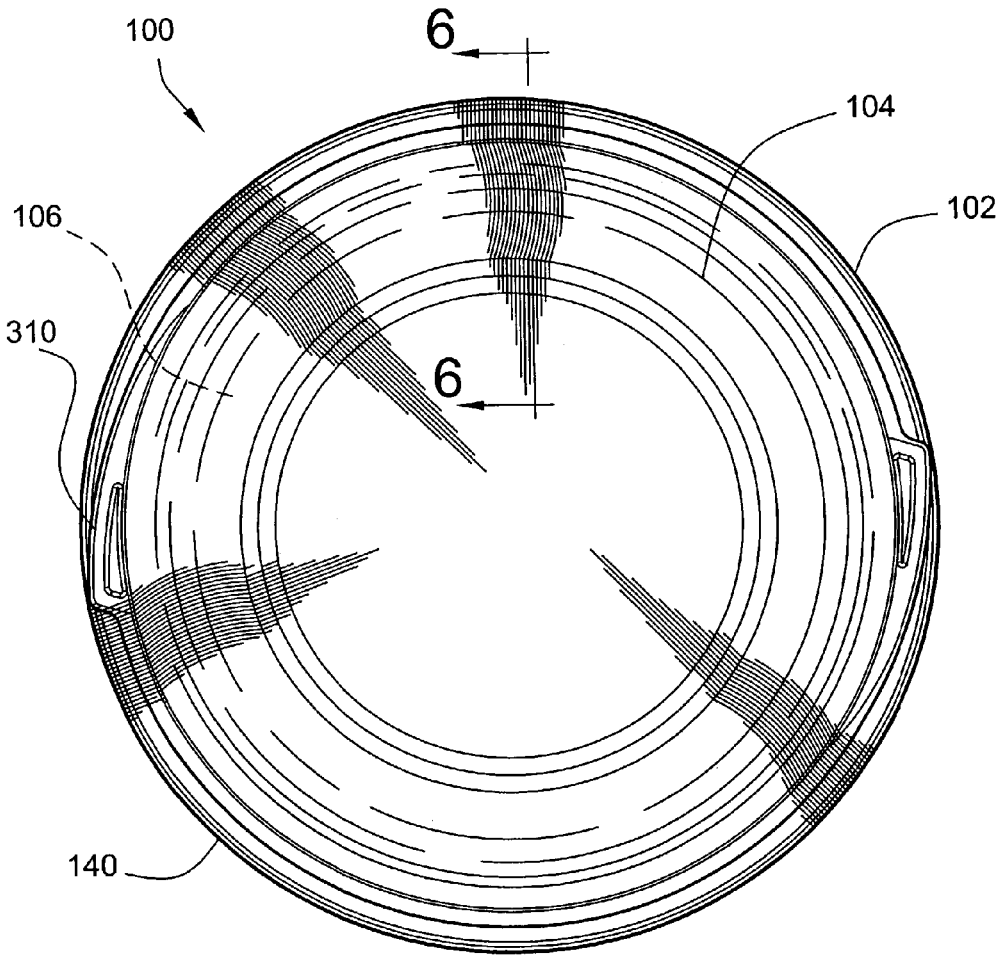
FIG. 4 is a top plan view of the container of FIG. 1.
Figure 5:
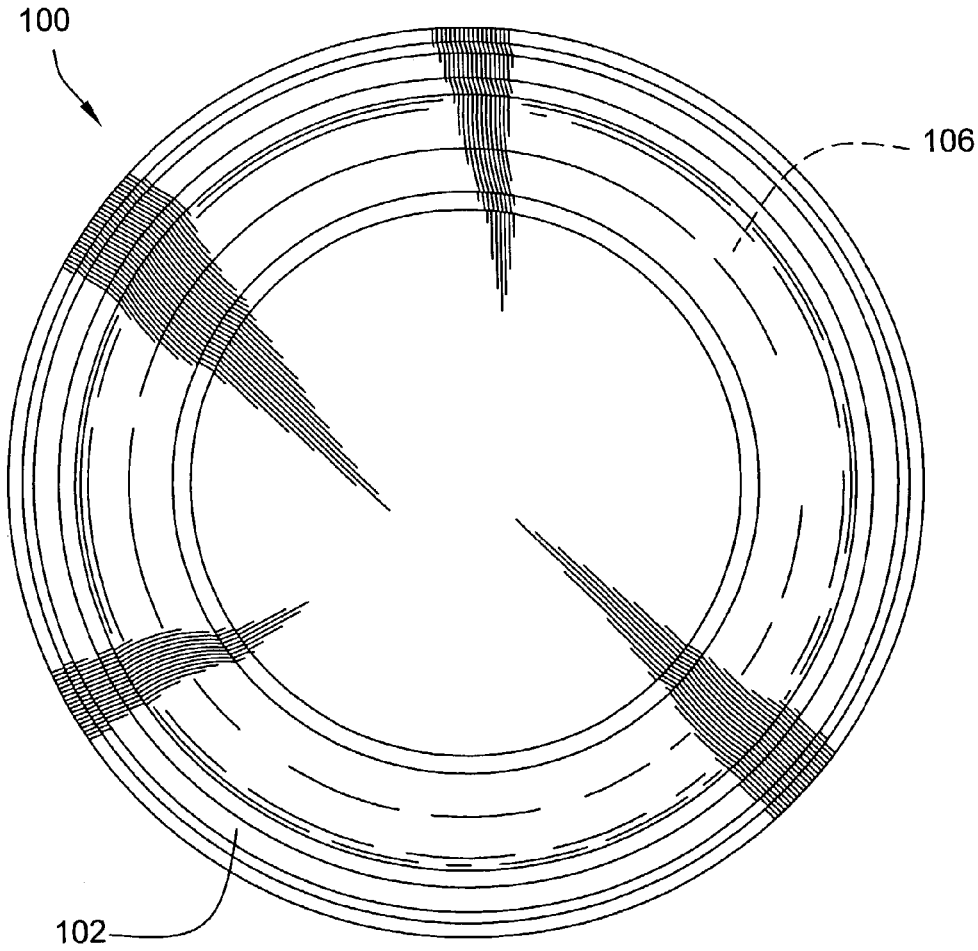
FIG. 5 is a bottom plan view of the container of FIG. 1.
Figure 17:
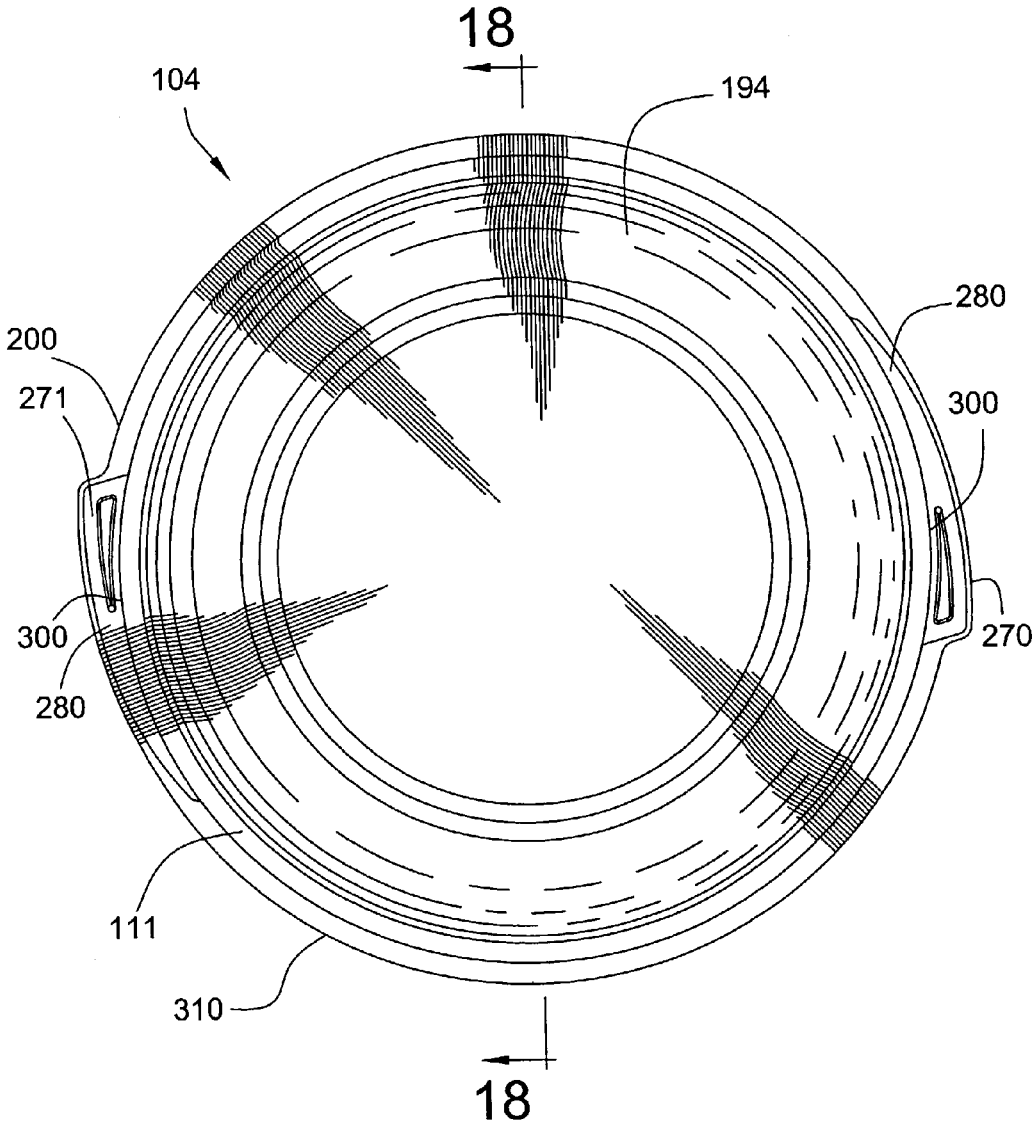
FIG. 17 is a bottom plan view of the cover of FIG. 13.

Referring to FIGS. 17 and 20, by extending along the periphery of the flange 200, the rib 280 of the tab 271 defines an arc-shaped, elongated relieved portion 300. The configuration of the rib 280 defines the relieved portion 300 such that it extends over a relatively large arc of the second closure portion 111, thereby facilitating removal of the cover 104 from the base and providing the cover 104 with an outer periphery 310 that does not extend outwardly beyond the flange 140 of the base 102 when the cover is occluded thereto, as shown in FIG. 4. In other embodiments, the outer periphery 310 of the cover 104 can extend outwardly beyond the flange 140 of the base 102.

The relieved portion of the tab permits container venting by allowing a portion of the cover 104 to be removed from the base 102 while still maintaining a seal around the remaining perimeter of the container. This feature is useful in microwave cooking where the cover 104 prevents food from splattering onto the inside surface of the microwave while still allowing the container to vent.

By utilizing at least one of the tabs, less force is required to remove the cover 104 from the base 102. The lower opening force also reduces the possibility for container failure from stress and fatigue. The lower opening force can improve the ability of the user to maintain control over the container components while removing the cover from the base to reduce the possibility of spilling the contents stored in the container during removal of the cover from the base.

In addition, the lower opening force may be beneficial when the container is used in a freezer. Some materials which may be used to make the container may become brittle at or near freezer temperatures. Consequently, if the container is removed from the freezer and immediately opened, the material for the container (and thus the container) are subject to the failure if the opening force is too high. Therefore, the lower opening force reduces the possibility of failure when the container is removed from the freezer and immediately opened.

Referring to FIG. 20, the gripping tab 271 can be configured such that the respective gripping tab extends outwardly from the raised rib 280 a predetermined distance 320, measured between an outer end 322 of the raised rib 280 and the tool side trim edge 244. The distance 320 that the gripping tab extends from the rib 280 can be at least equal to one-half of a height 326 of the raised rib 280, measured from the top surface 243 adjacent to the trim edge 244 to a top 330 of the raised rib 280, thereby facilitating proper pilot design during a punch-and-die trimming operation, for example.

The thinner container cover reduces material costs and increases flexibility to more easily accommodate its removal from, and engagement onto, the base. The cover 104 can maintain adequate flexibility for proper sealing even during typical freezer temperatures. Furthermore, the lack of surface detail on the container material provides for easy washing.

Figure 21:
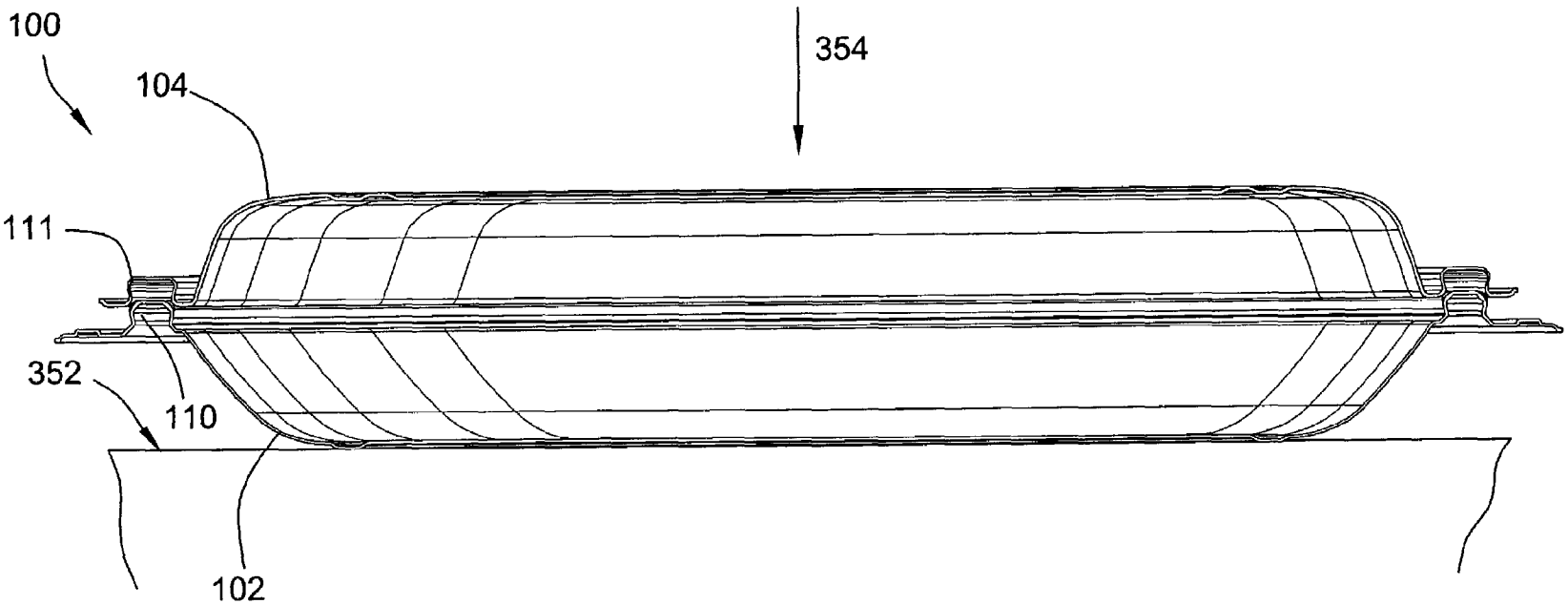
FIG. 21 is a cross-sectional view of the container of FIG. 1, similar to the views in FIGS. 11 and 18, showing the cover and the base in an initial occlusion position.
Figure 22:
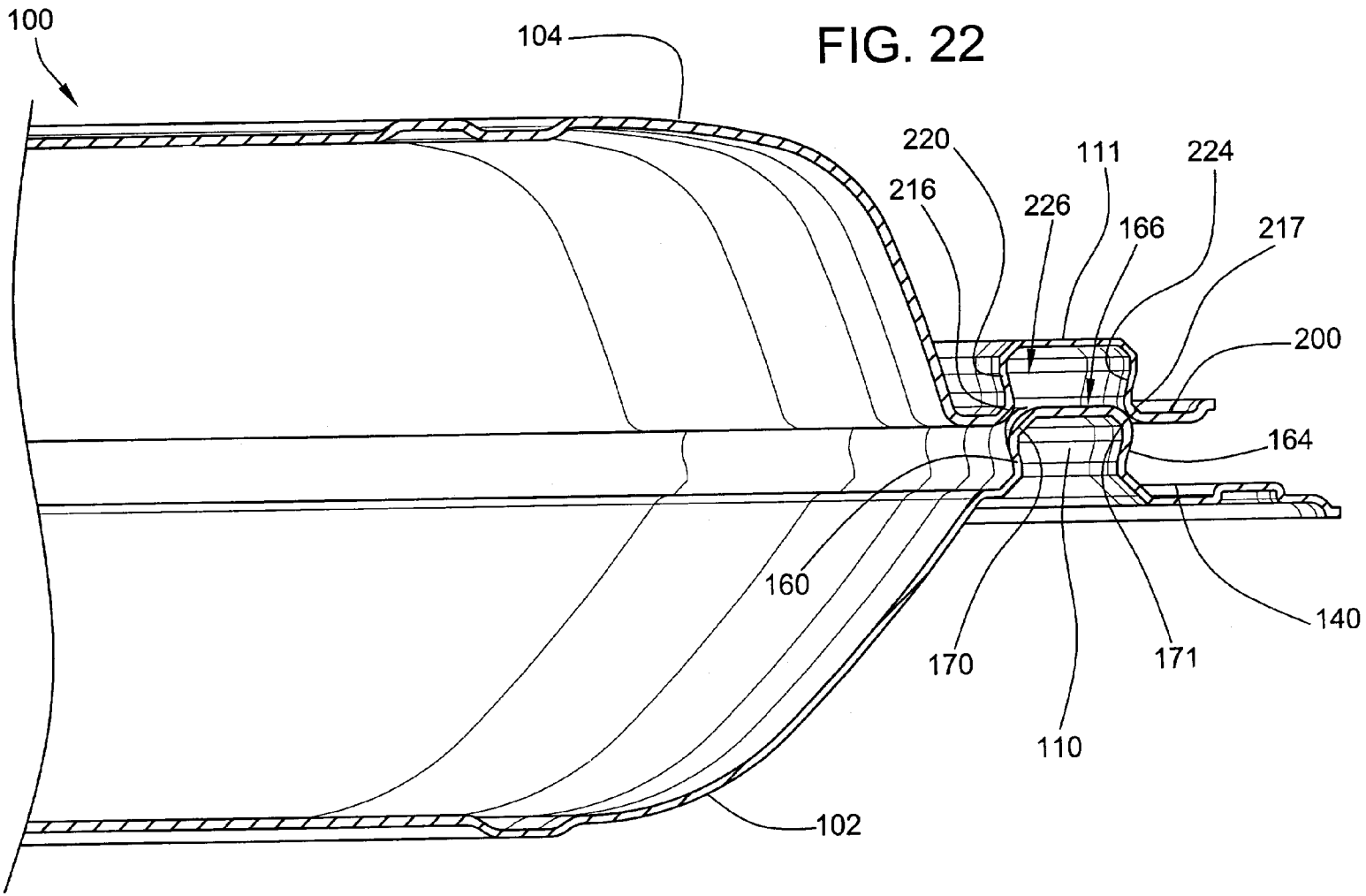
FIG. 22 is an enlarged, detail view taken from FIG. 21.
Figure 23:
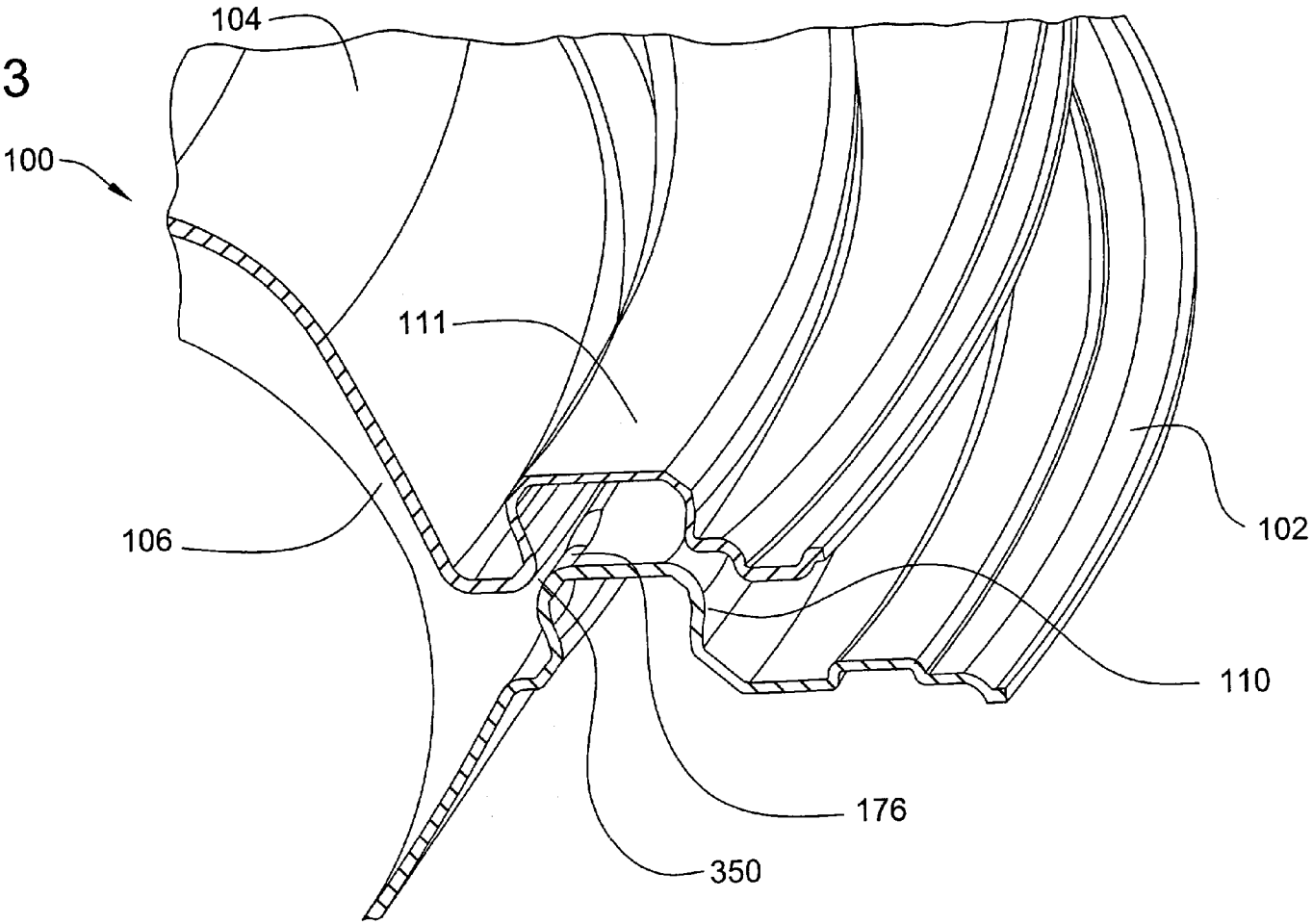
FIG. 23 is an enlarged, fragmentary, perspective view, in section of the container of FIG. 1 showing the cover and the bottom in an initial occluded position.

Referring to FIGS. 21–25, an occlusion sequence for the container 100 is shown wherein the cover 104 is sealingly secured to the base 102. Referring to FIG. 21, the cover 104 is resting upon the base 102 with the second closure portion 111 aligned with the first closure portion 110. Referring to FIG. 22, the nest lugs 216, 217 of the second closure portion 111 are in respective contact with the shoulders 170, 171 of the first closure portion 110. The second sealing surface 226 of the second closure portion is disposed over the first sealing surface 166 of the first closure portion. Referring to FIG. 23, the notch 176 adjacent the inner wall 160 of the first closure portion 110 cooperates with the second closure portion 111 to define an air passageway 350 for venting the storage area 106 of the container 100 during the occlusion of the cover 104 and the base 102.

Referring to FIG. 21, the container 100 can be closed, for example, by placing the base 102 on a supporting surface 352 and placing the cover 104 upon the base 102. The cover 104 can be pushed toward the base 102 with the supporting surface 352 holding the base in place to allow the closure portions 110, 111 to engage each other to seal the container 100. To occlude the cover and the base, a sealing force is applied to the cover 104 in a sealing direction 354 such that the sealing force moves the cover 104 and the base 102 relatively toward each other. The cover 104 and the base 102 are between the application of the sealing force and the supporting surface 352 to overcome the interference between the closure portions 110, 111. The cover 104 and the base 102 can be occluded by aligning the first closure portion 110 with the second closure portion 111 and applying a force from underneath the first closure portion 110 and an oppositely directed force from above the second closure portion 111 as would be accomplished by pinching, and then applying this force all the way around the closure perimeters so as to completely occlude the container.

Figure 24:
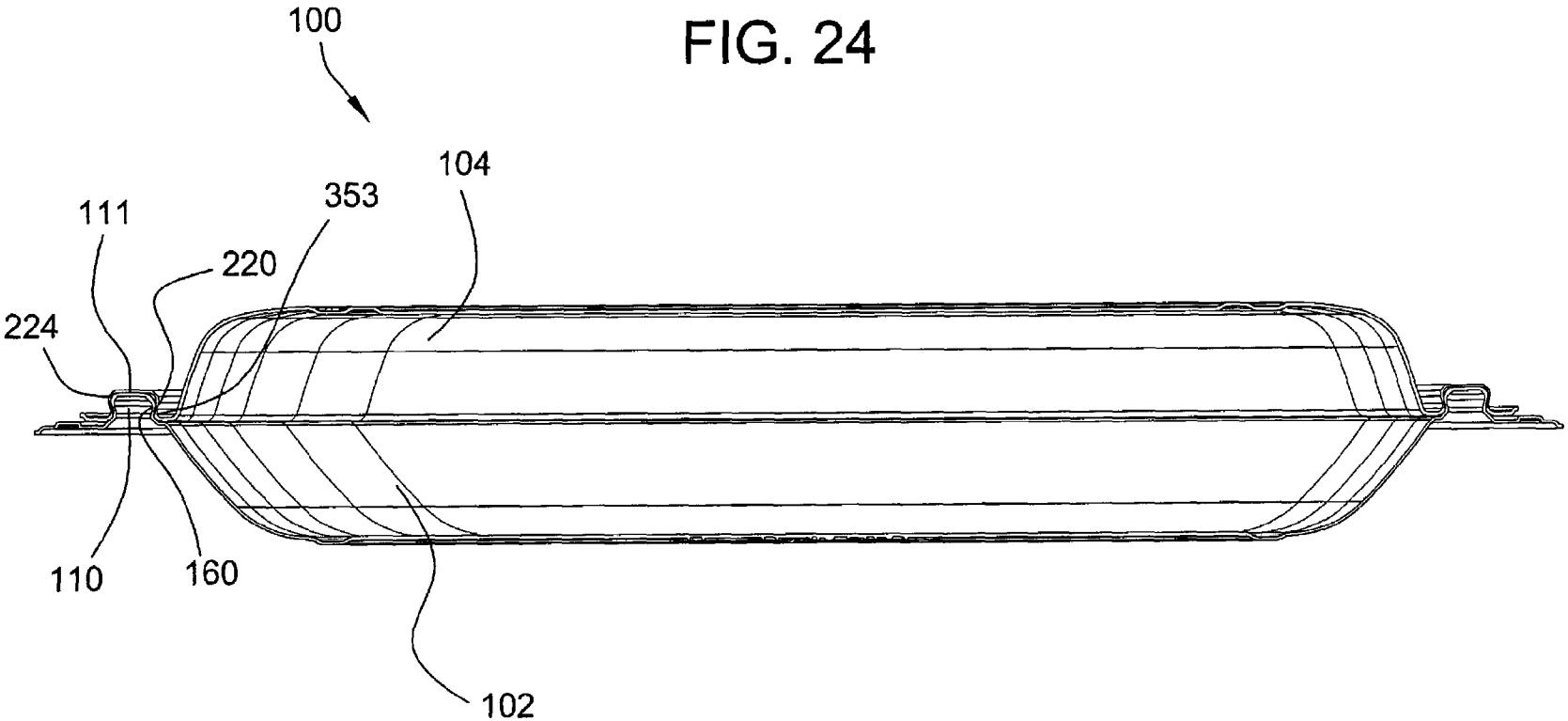
FIG. 24 is a cross-sectional view similar to FIG. 21, showing the cover and the bottom in an occluded position.
Figure 25:
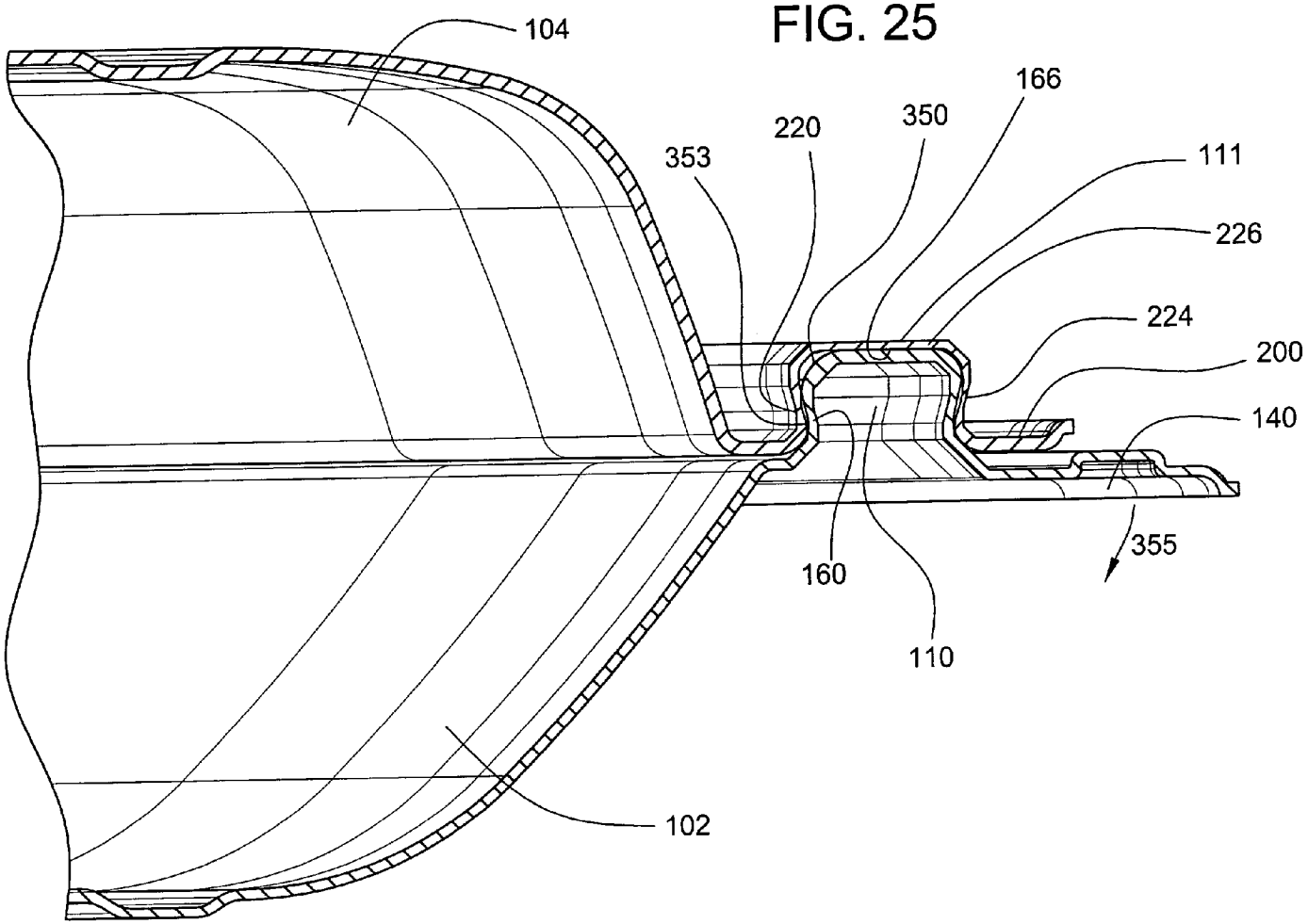
FIG. 25 is an enlarged, detail view taken from FIG. 24.

Referring to FIG. 22, the inner and outer walls 220, 224 of the second closure portion 111 deflect away from each other while passing over the shoulders 170, 171 of the first closure portion 110. Once beyond the shoulders 170, 171 of the base 102, the inner and outer walls 220, 224 of the cover 104 move toward each other toward their normal position, respectively acting against the inner and outer walls 160, 164 of the first closure portion 110 of the base 102. The retracting of the inner and outer walls 220, 224 of the cover 104 causes the cover 104 to move toward the base 102 until the sealing surface 226 of the cover 104 rests against the sealing surface 166 of the base 102, as shown in FIGS. 22, 24 and 25. In addition, the engagement of the first and second closure portions 110, 111 in an occluded position can be accompanied by an audible "snap," indicating that the container is securely closed.

In the occluded position, as shown in FIGS. 24 and 25, the inner and outer walls 220, 224 of the cover 104 can be displaced from their normal position to an intermediate engaged position. The inner wall 220 of the cover 104 can exert a force against the inner wall 160 of the base 102 to form a seal 353. Referring to FIG. 25, the first sealing surface 166 of the first closure portion 110 is in sealing engagement with the second sealing surface 226 of the second closure portion. The first and second closure portions 110, 111 cooperate when in the occluded position to close the air passageway 350 to provide a substantially continuous seal between the cover 104 and the base 102.

The first and second closure portions 110, 111 can be configured to be slightly different in size to form an interference fit therebetween. The interference fit between the first and second closure portions 110, 111 can provide the sealing engagement between the closure portions to occlude the cover 104 and the base 102. As a result, when the two pieces are engaged, a positive seal can be formed around the inside perimeter of the container at the point where the inner wall 160 of the base 102 contacts the inner wall 220 of the cover 104. In one embodiment, the range of interference fit between the inner walls 160, 220 is about 0.005 to about 0.020 inches.

The closure portions can have several other sealing areas when the cover engages the base. For example, an interference fit can be accomplished between the first and second closure portions 110, 111 to provide the sealing engagement between the closure portions to occlude the cover 104 and the base 102 whereby when the two pieces are engaged, a positive seal can be formed around the outside perimeter of the container at the point where the outer wall 164 of the base 102 contacts the outer wall 224 of the cover 104. In one embodiment, the range of interference fit is about 0.005 to about 0.020 inches.

Referring to FIG. 25, when the first and second closure portions 110, 111 are sealingly engaged with each other, the flange 140 of the base 102 is closely adjacent the flange 200 of the cover 104. The flange 140 of the base can be resiliently flexible such that the flange 140 can be flexed away from the cover 104 in an opening direction 355 to provide a separation between the flanges 140, 200 for facilitating the removal of the cover 104 from the base 102.

Referring to FIGS. 26–29, a plurality of containers, and a plurality of container components, can be stacked together. The components of the container can be nested, and several containers can be nested together. A plurality of containers can be stacked vertically.

Figure 26:
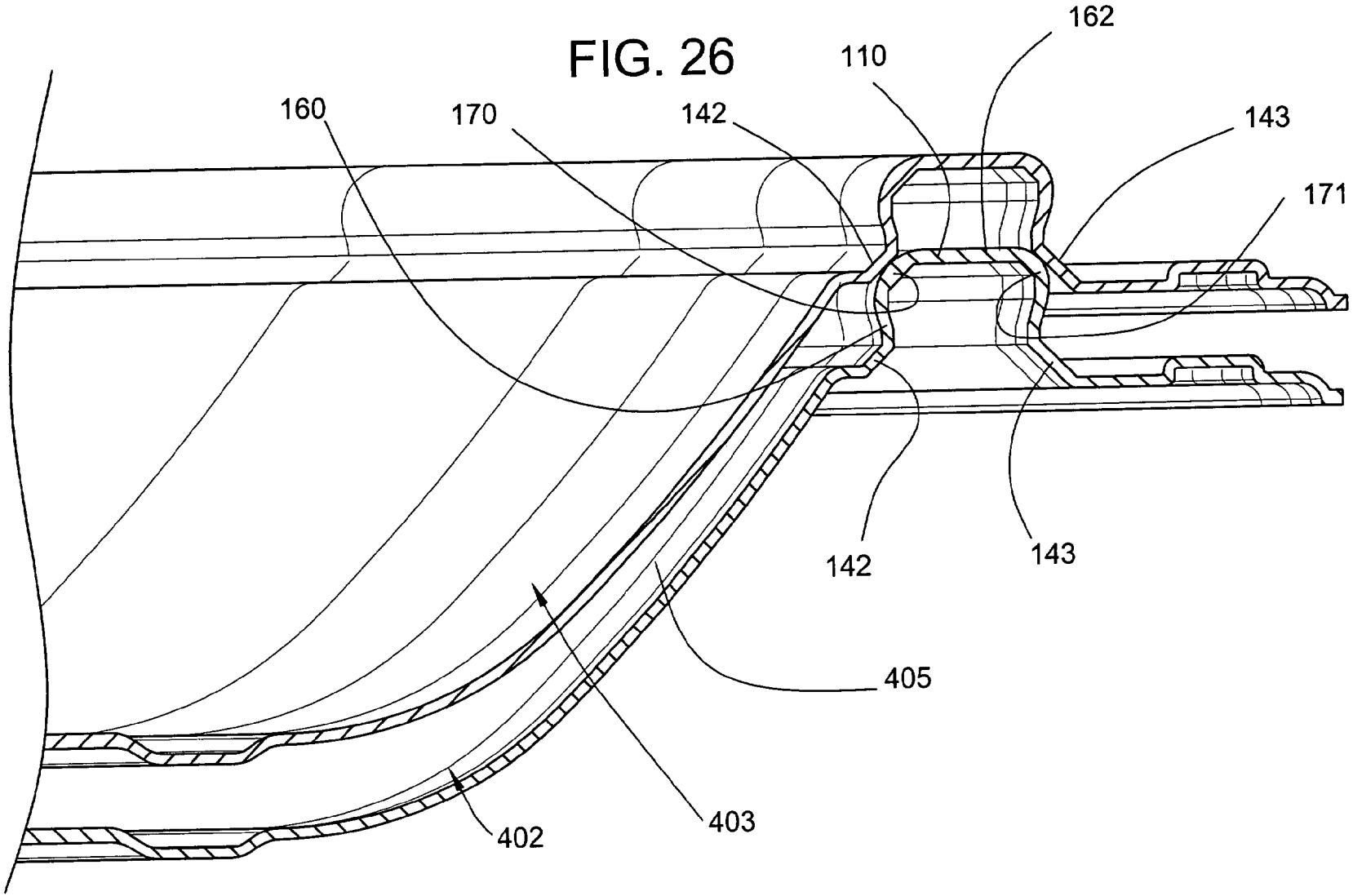
FIG. 26 is an enlarged cross-sectional view of a pair of bases, as in FIG. 12, illustrating the bottoms in a nested configuration.

Referring to FIG. 26, a plurality of bases 402, 403 can be stacked together in a nested arrangement. When the bases 402, 403 are nested, the nest lugs 142, 143 of the upper container base 403 rest on the retention bead 162 of the first closure portion 110 of the lower container base 402. The nest lugs 142, 143 of the upper container base 403 are in respective contact with the shoulders 170, 171 of the retention bead 162 of the lower container base 402. The nest lugs 142, 143 of the lower container base 402 are configured such that the lower container base 402 can be stacked upon yet another container base with the lower container base 402 contacting that container base in the same manner as the upper container base 403 contacts the lower container base 402. The inner wall 160 of the lower container base 402 can be designed to be a predetermined length to maintain an air space 405 between the sidewall 122 of the lower container base 402 and the sidewall 122 of the upper container base 403 such that the unintentional interlocking of container bases 402, 403 is avoided. Each container base 102 can be configured to provide a low stacking height when nested together to facilitate packaging and minimize storage space.

Figure 27:
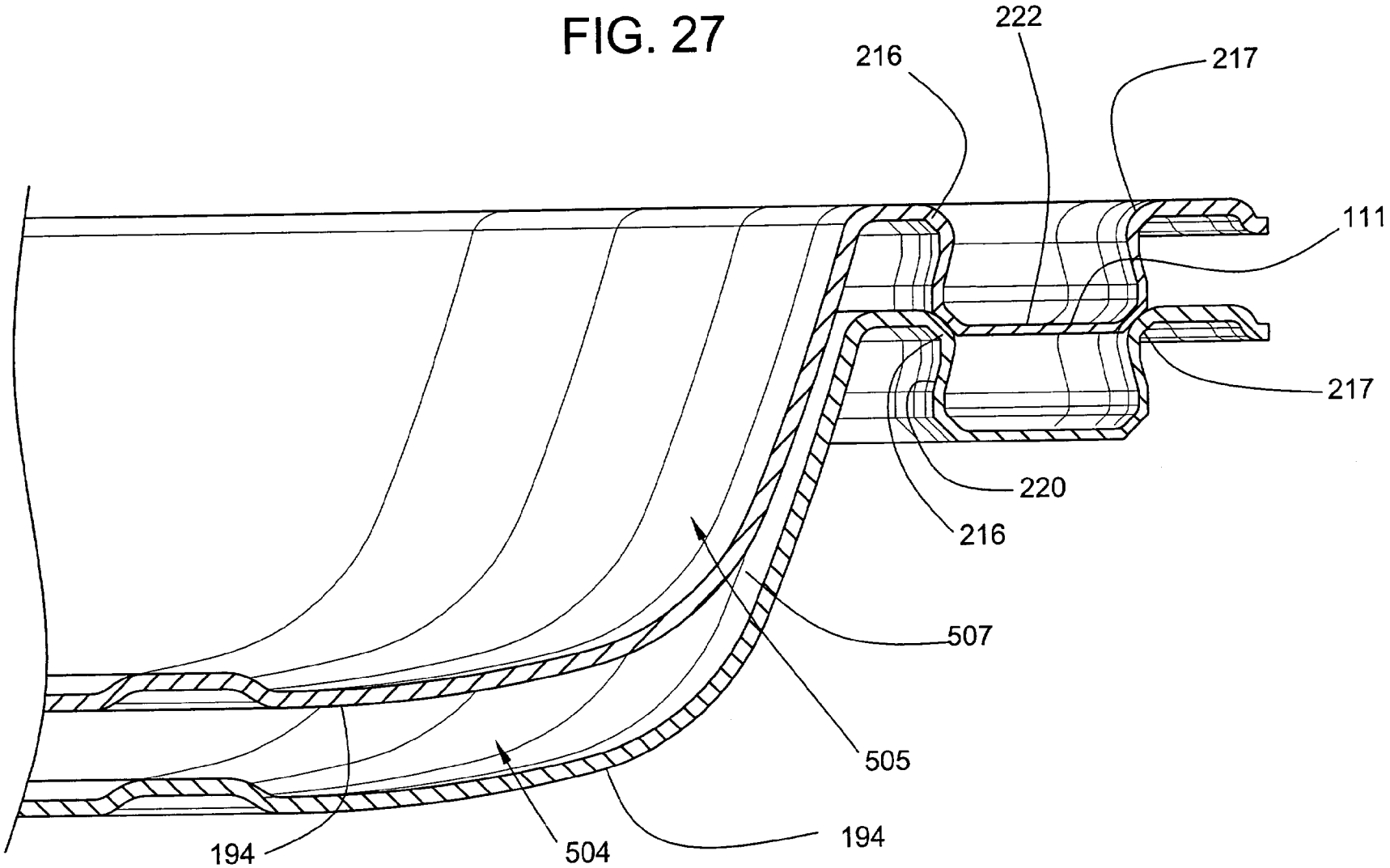
FIG. 27 is an enlarged, fragmentary, cross-sectional view of a pair of covers, similar to FIG. 18, illustrating the covers in a nested configuration.

Referring to FIG. 27, a plurality of container covers 504, 505 is stacked together in a nested arrangement. When the container covers 504, 505 are stacked together in a nested formation, the retention bead 222 of the second closure portion 111 of the upper container cover 505 rests upon the nest lugs 216, 217 of the lower container cover 504. The portions of the container covers 504, 505 in contact with each other prevent the container covers 504, 505 from interlocking as well as provide support for retaining the nested stack in a secure position. The inner wall 220 of the lower container cover 504 can be configured to be a predetermined length to maintain an air space 507 between the raised dome 194 of the upper container cover 505 and the raised dome 194 of the lower container cover 504.

The nest lugs 216, 217 of the upper container cover 505 are disposed such that they can receive the retention bead of yet another container cover to add to the nested stack.

Figure 28:
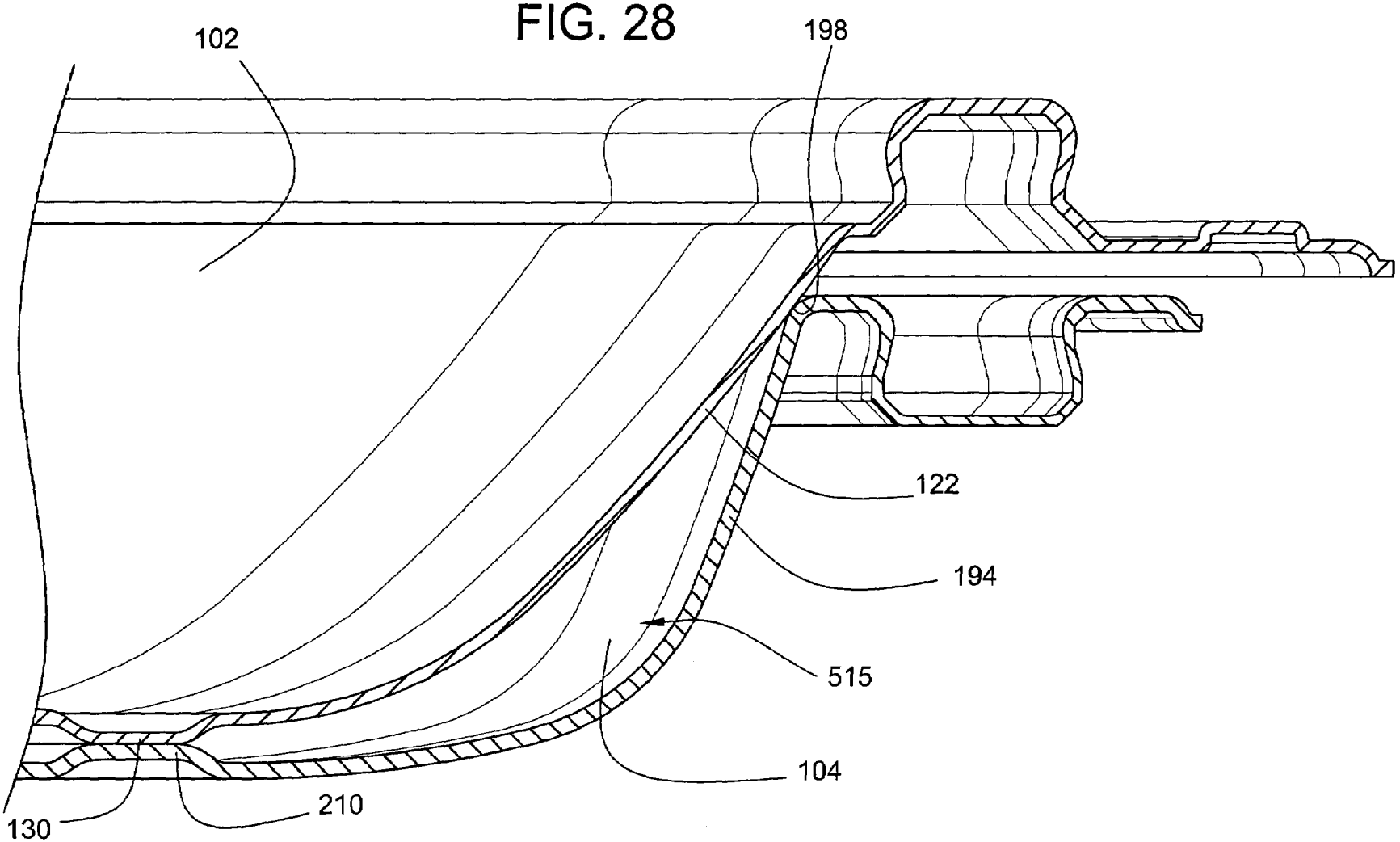
FIG. 28 is a fragmentary, enlarged cross-sectional view of a base and a cover similar to the views shown in FIGS. 26 and 27, showing the base and the cover in a nested configuration.

Referring to FIG. 28, the base 102 can be nested within the cover 104 when the cover 104 is in an inverted position. The base 102 and the cover 104 can be nested such that the base 102 rests upon the cover 104 with the first stacking element 130 contacting the second stacking element 210 and the side wall 122 of the base 102 contacting the perimeter 198 of the dome 194 of the cover 104. The second stacking element 210 of the cover 104 acts as a standoff to position the base 102 with respect to the cover 104 such that a cavity 515 is defined, thereby preventing the interlocking of the base 102 and the cover 104 in this position.

The nested arrangement shown in FIG. 28 provides a convenient storage position for the cover 104 when the base 102 is used as a serving dish. The cover 104 can be conveniently stored in an inverted position below the base 102 during use. In such a stored position, the cover 104 can be kept with the base 102, thereby reducing the likelihood of misplacing the cover.

A stack of bottoms can be nested with a stack of covers such that the stack of bottoms are uninterrupted and the stack of covers are uninterrupted with the lowermost bottom being in contact with the uppermost cover, as shown in FIG. 28. This configuration provides for an efficient stacking arrangement for packaging a set of bases and covers for display at the point of retail in that it reduces the size of the overall package as compared to an arrangement where the cover 104 was not inverted. If the cover 104 were not inverted, the overall height occupied by one container would be preserved, resulting in a greater overall package size.

Figure 29:
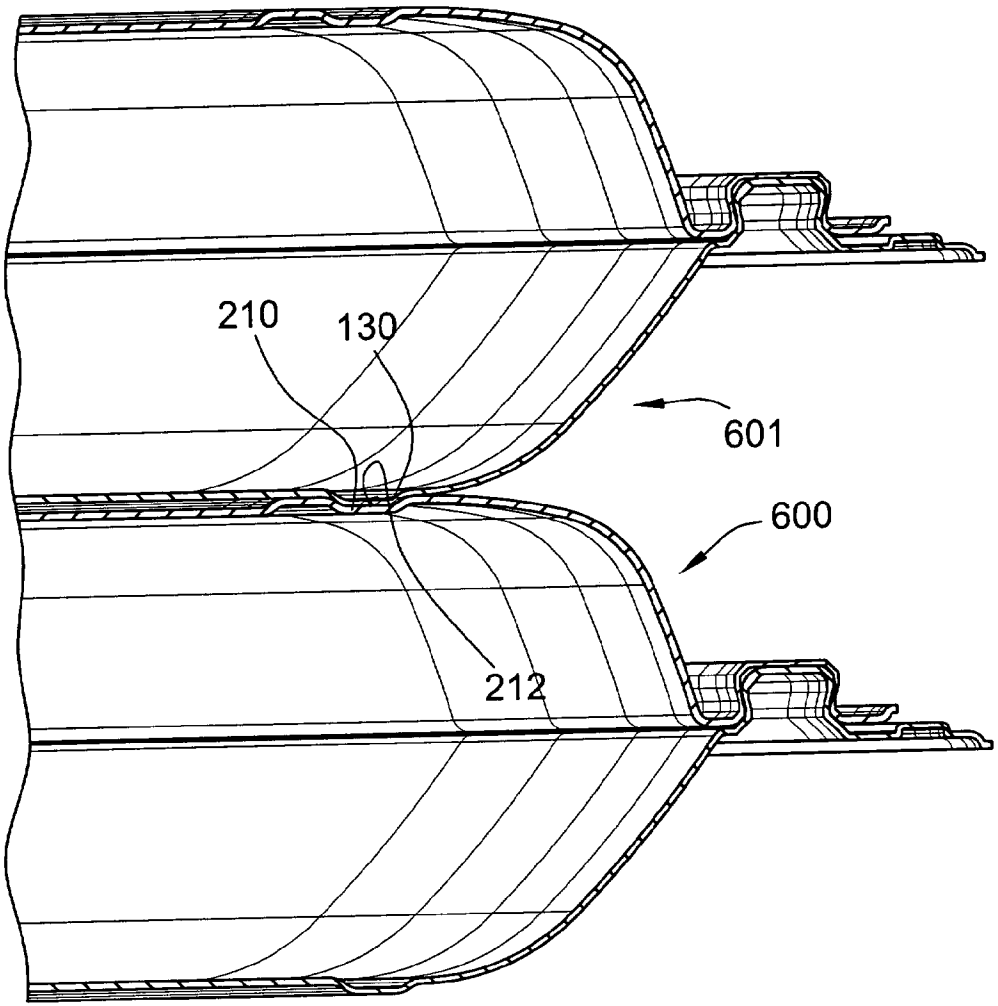
FIG. 29 is an enlarged, fragmentary, cross-sectional view similar to FIG. 27 except that the bottom is stacked upon the cover.
Figure 30:
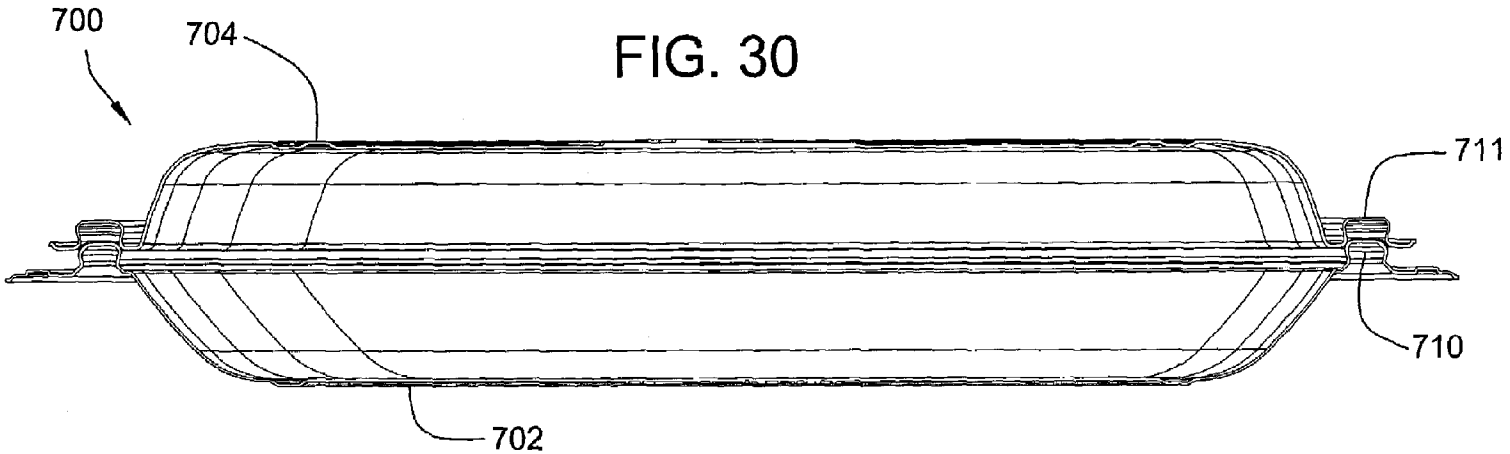
FIG. 30 is a cross-sectional view similar to FIG. 21, showing another embodiment of a container.
Figure 32:
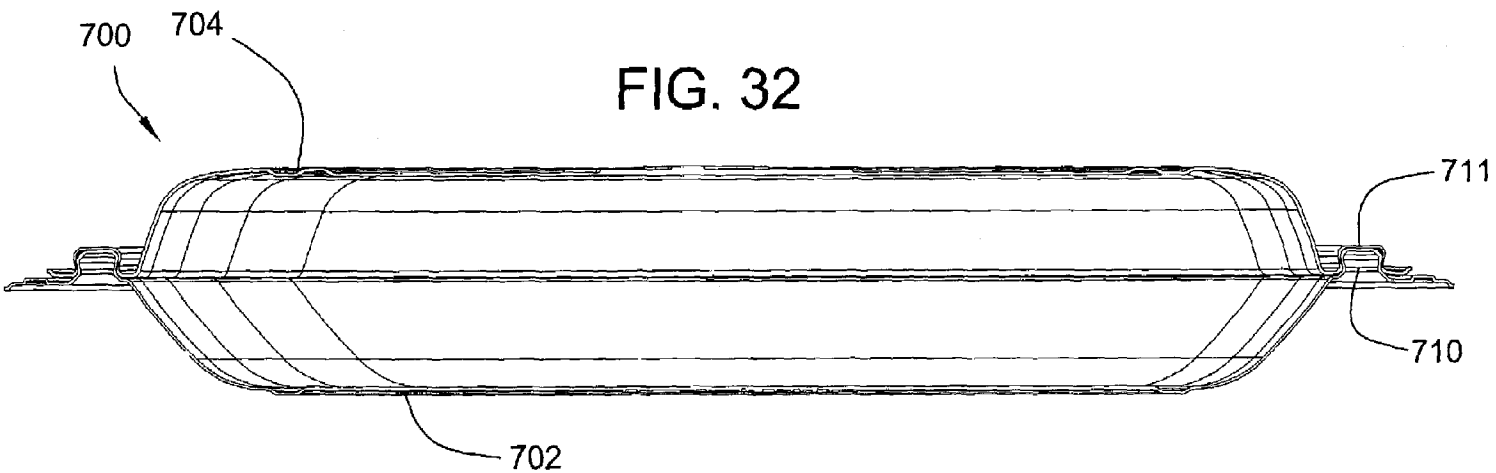
FIG. 32 is a cross-sectional view similar to FIG. 30, showing the cover and the bottom in an occluded position.

Referring to FIG. 29, the occluded container can be stacked vertically. The first stacking element 130 and the second stacking element 210 have complementary configurations such that the second stacking element 210 of a first container 600 can engage the first stacking element 130 of a second container 601 to facilitate the alignment of the containers 600, 601 and to assist in stacking the containers 600, 601.

The groove 212 defined by the second stacking element 210 of the cover is configured to accept the first stacking element 130 of the base. The groove 212 can act to secure the first stacking element 130 to reduce relative transverse movement between the first and second containers 600, 601. The stacking elements 130, 210 can maintain the closed containers in vertical alignment when placed in a stacked position, thereby minimizing shelf space within a cabinet, refrigerator, or freezer, for example, while providing for a stable stacking arrangement.

Figure 31:
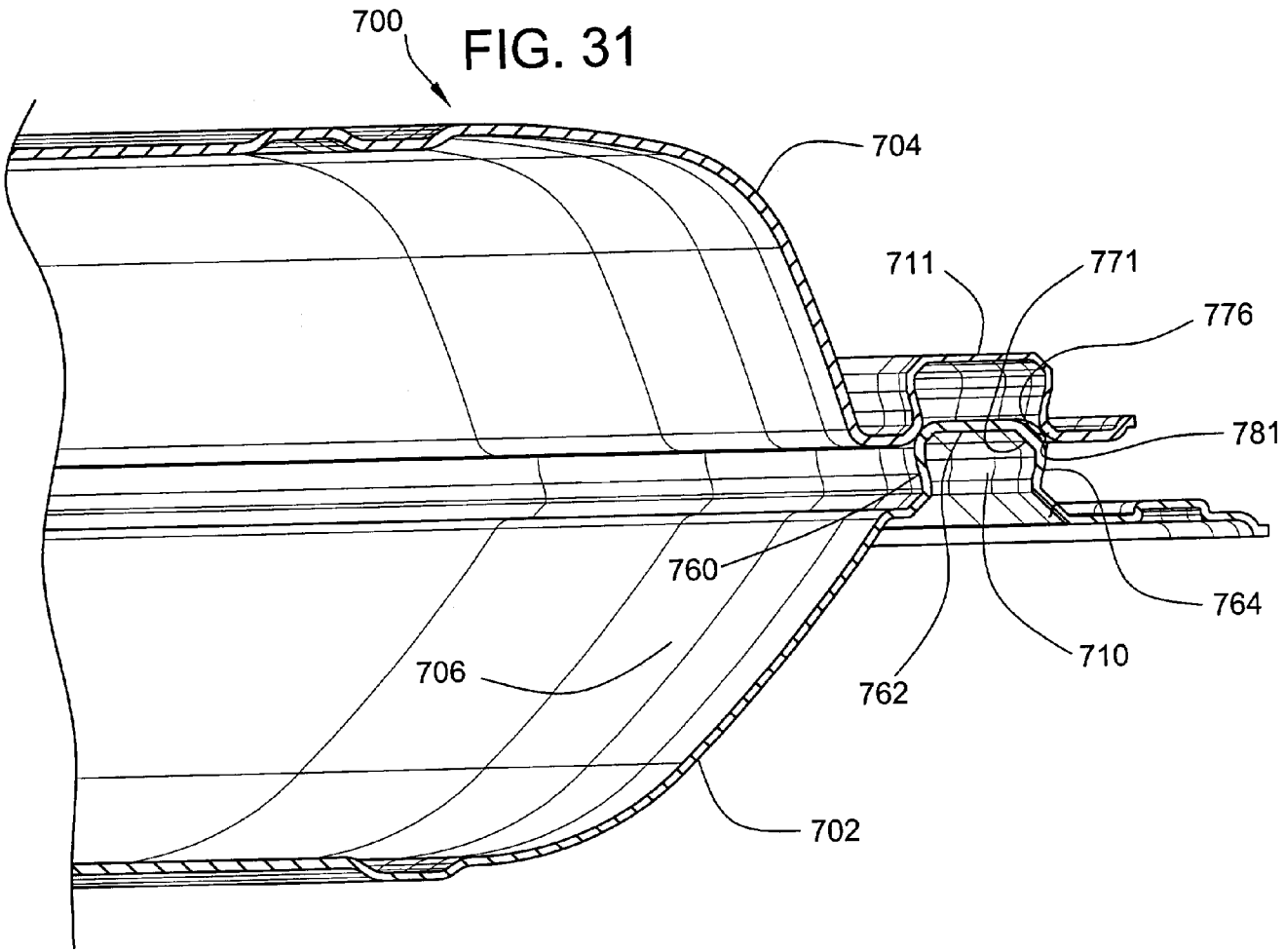
FIG. 31 is an enlarged, detail view taken from FIG. 30.

Referring to FIGS. 30–33, another embodiment of the container 700 is shown. The container 700 undergoes an occlusion sequence in FIGS. 30–33. The container 700 includes a base 702 and a cover 704, which include a first and a second closure portion 710, 711, respectively. Referring to FIG. 31, the first closure portion 710 includes an inner wall 760, a retention bead 762 and an outer wall 764. The first closure portion 710 includes a notch 776 adjacent the outer wall 764. The notch 776 is disposed at a second shoulder 771 of the retention bead 762. The notch 776 can cooperate with the second closure portion 711 to define an air passageway 781 for venting a storage area 706 of the container 700.

Figure 33:
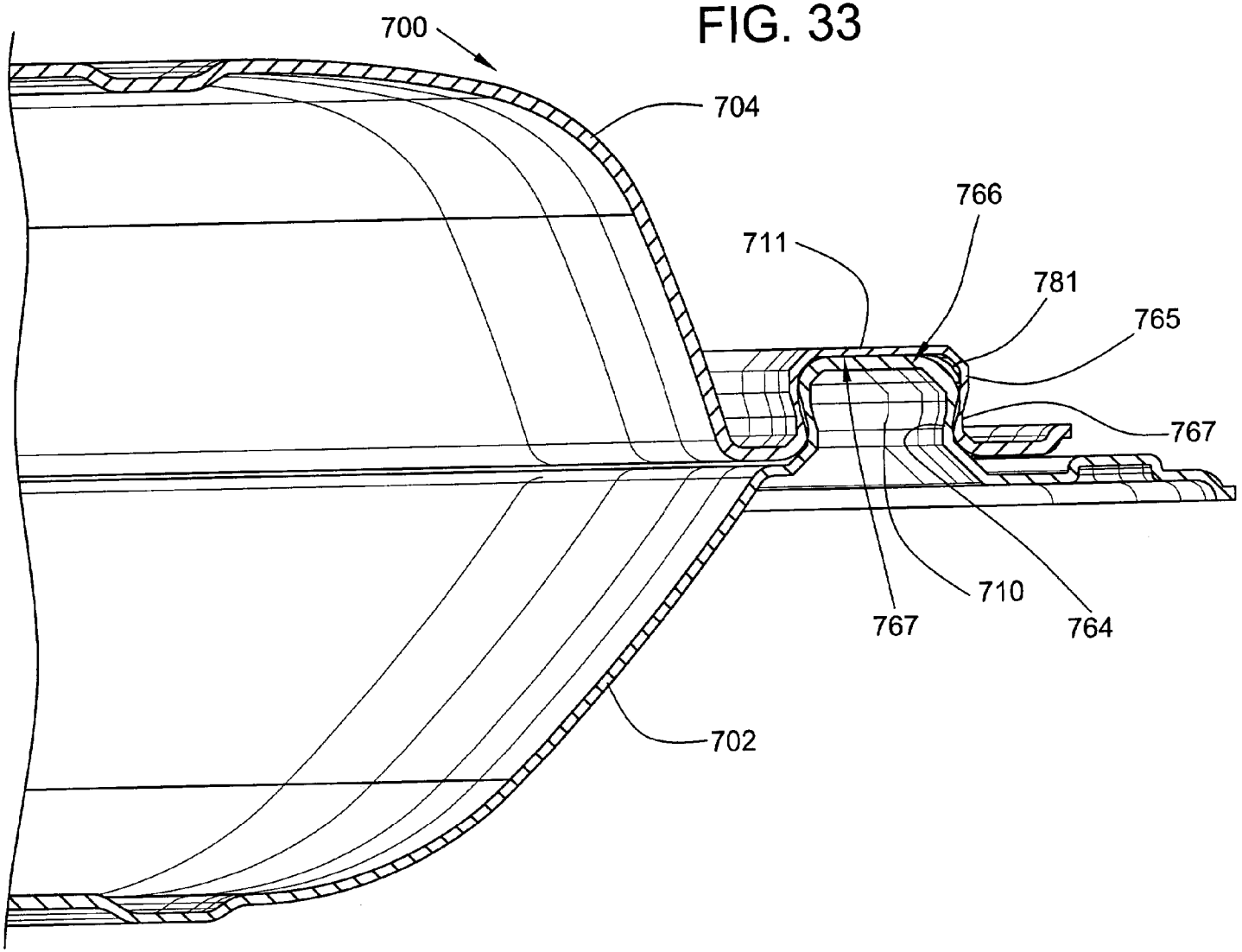
FIG. 33 is an enlarged, detail view taken from FIG. 32.
Figure 34:
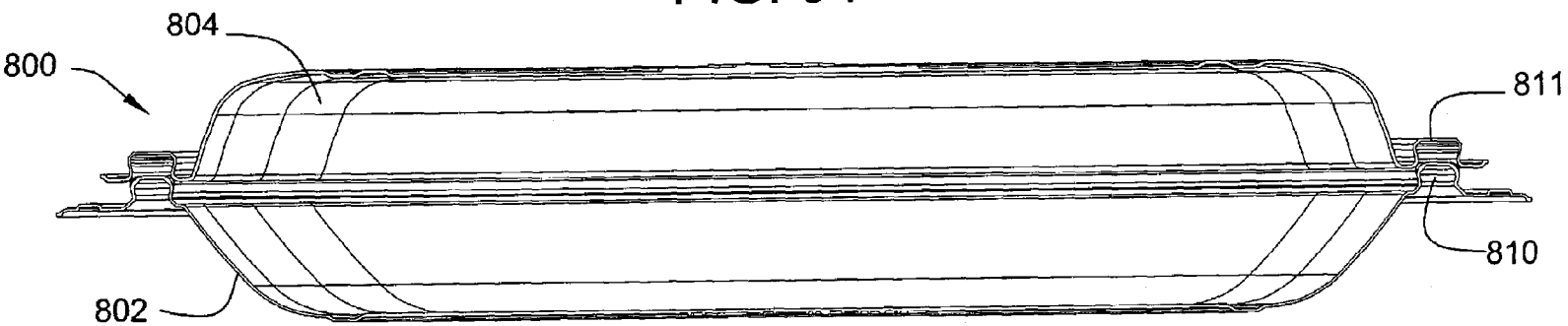
FIG. 34 is a cross-sectional view similar to FIG. 21, showing yet another embodiment of a container.
Figure 36:
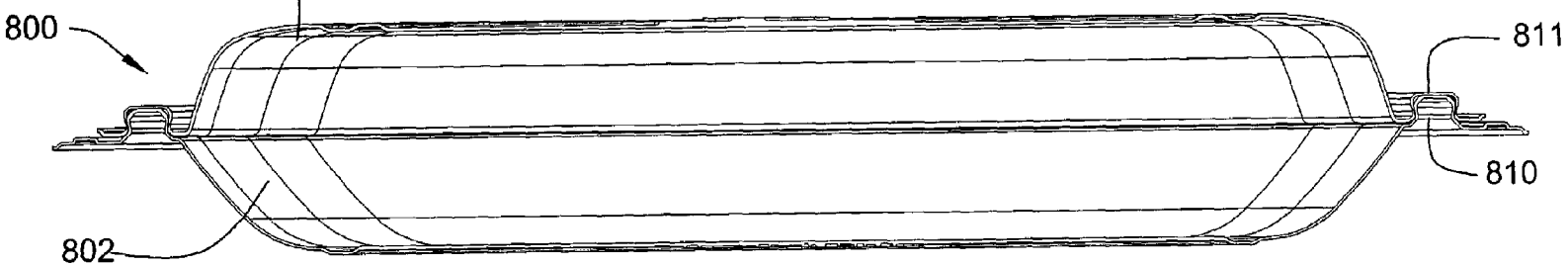
FIG. 36 is a cross-sectional view similar to FIG. 34, showing the cover and the bottom in an occluded position.

Referring to FIG. 33, the first and second closure portions 710, 711 are occluded to seal the container 700. The first and second closure portions 710, 711 cooperate in the occluded position to close the air passageway 781. Respective sealing surfaces 766, 767 of the first and second closure portions 710, 711 are in sealing engagement with each other. The outer wall 764 of the first closure portion 710 and an outer wall 765 of the second closure potion 711 cooperate to provide a substantially continuous seal 767 between the cover 704 and the base 702.

The container 700 is similar in other respects to the container 100 shown in FIG. 1.

Figure 35:
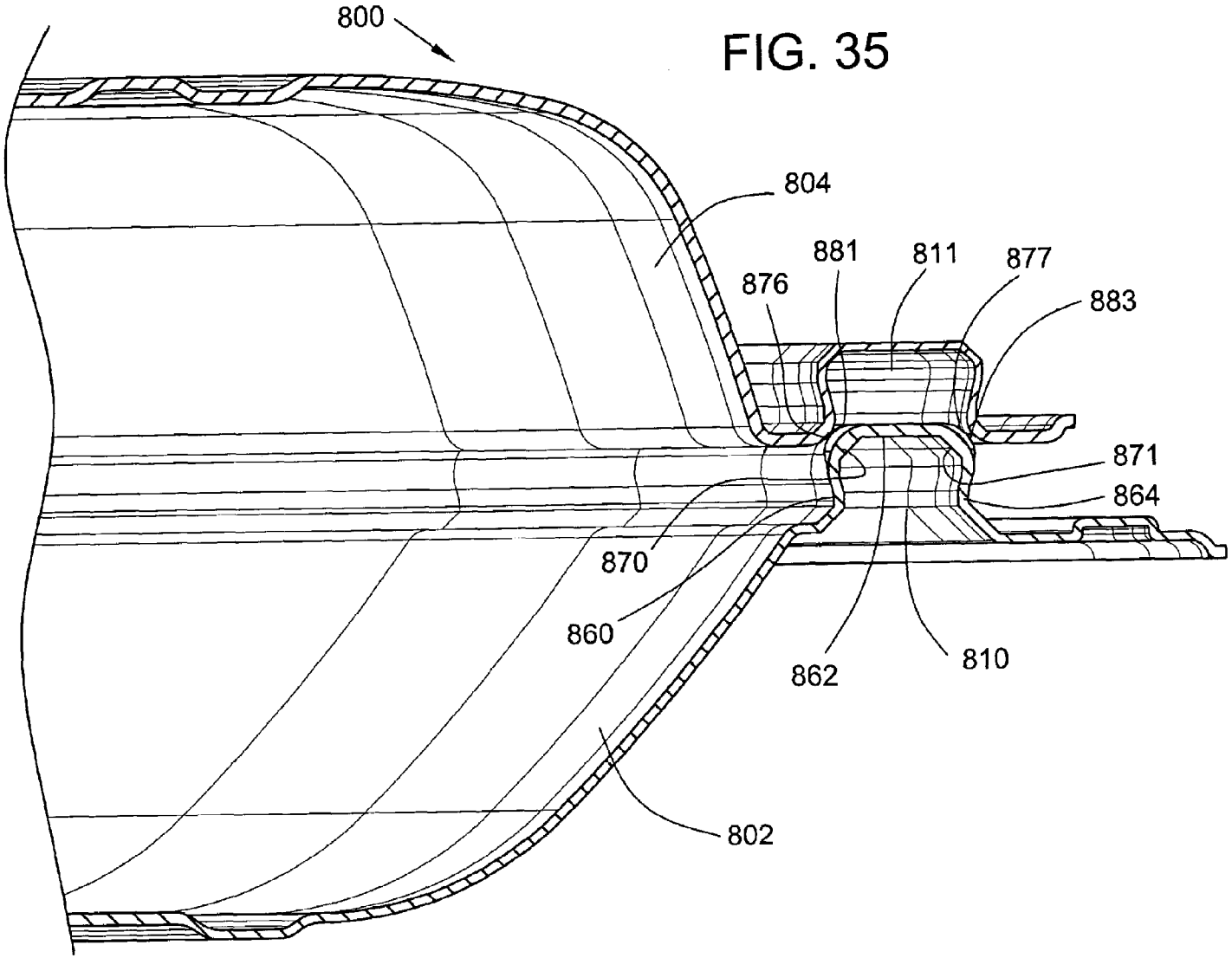
FIG. 35 is an enlarged, detail view taken from FIG. 34.

Referring to FIGS. 34–37, another embodiment of the container 800 is shown. The container 800 undergoes an occlusion sequence in FIGS. 34–37. The container 800 includes a base 802 and a cover 804, which includes a first and second closure portion 810, 811, respectively. Referring to FIG. 35, the first closure portion 810 includes an inner wall 860, a retention bead 862, and an outer wall 864. The retention bead 862 includes first and second shoulders 870, 871. Each shoulder 870, 871 includes a notch 876, 877, respectively. The notches 876, 877 are disposed adjacent the inner and outer walls 860, 864, respectively. The notches 876, 877 are substantially aligned with each other and in opposing relation with each other. The notches 876, 871 cooperate with the second closure portion 811 to define a pair of air passageways 881, 883 for venting the storage area of the container 800 during the occlusion of the cover 804 and the base 802.

Figure 37:
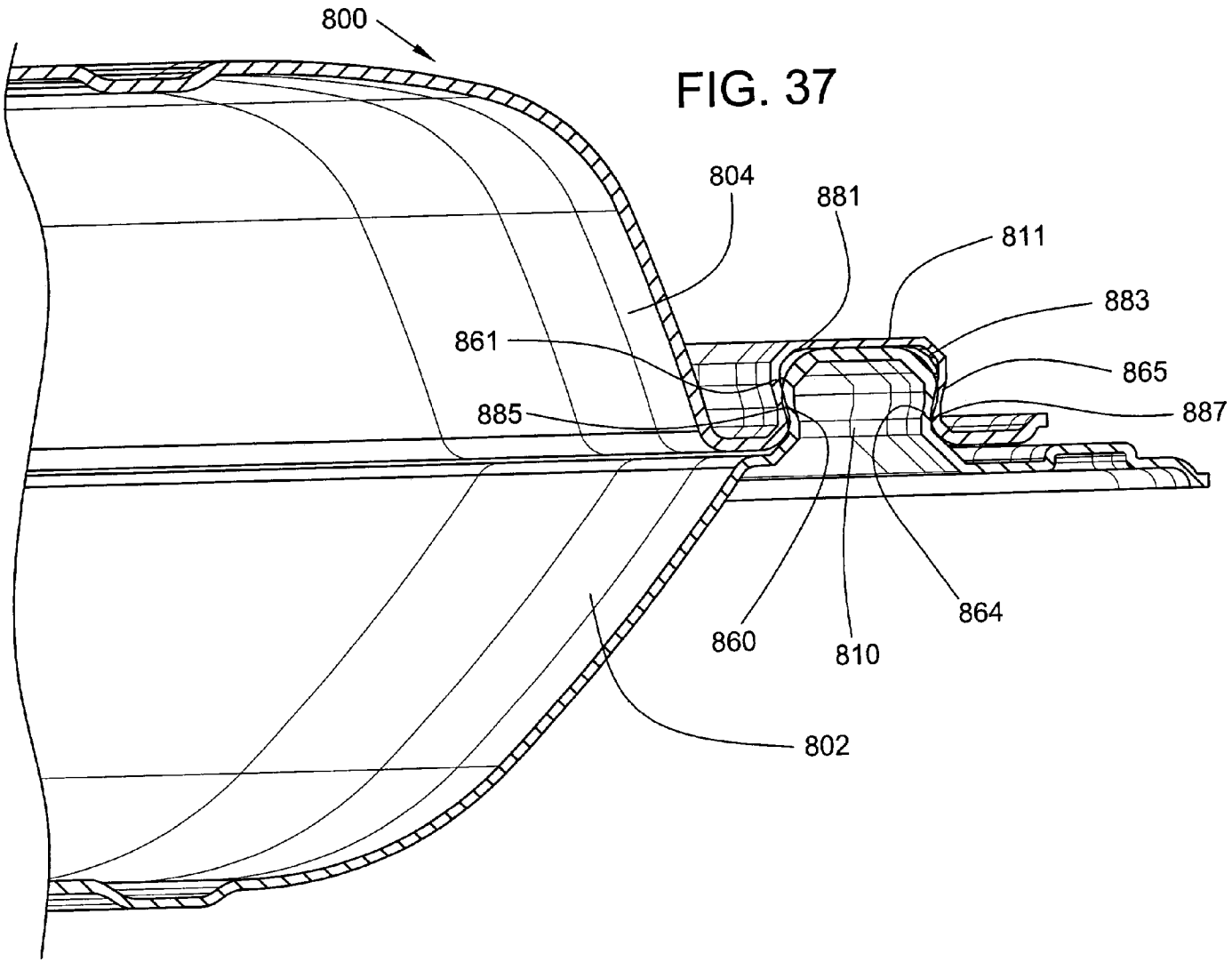
FIG. 37 is an enlarged, detail view taken from FIG. 36.
Figure 38:
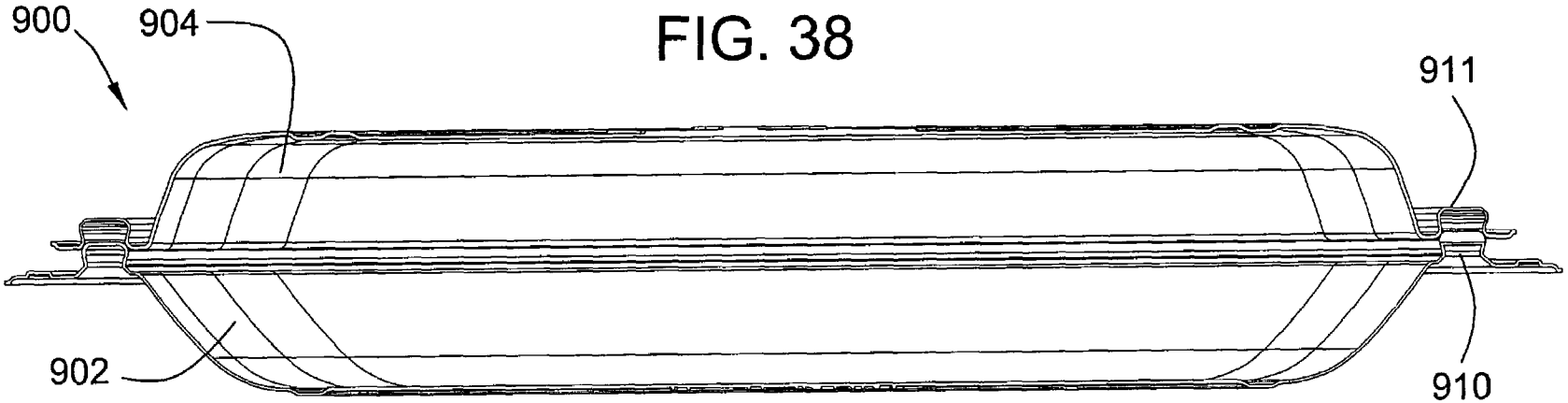
FIG. 38 is a cross-sectional view similar to FIG. 21, showing another embodiment of the container.
Figure 40:
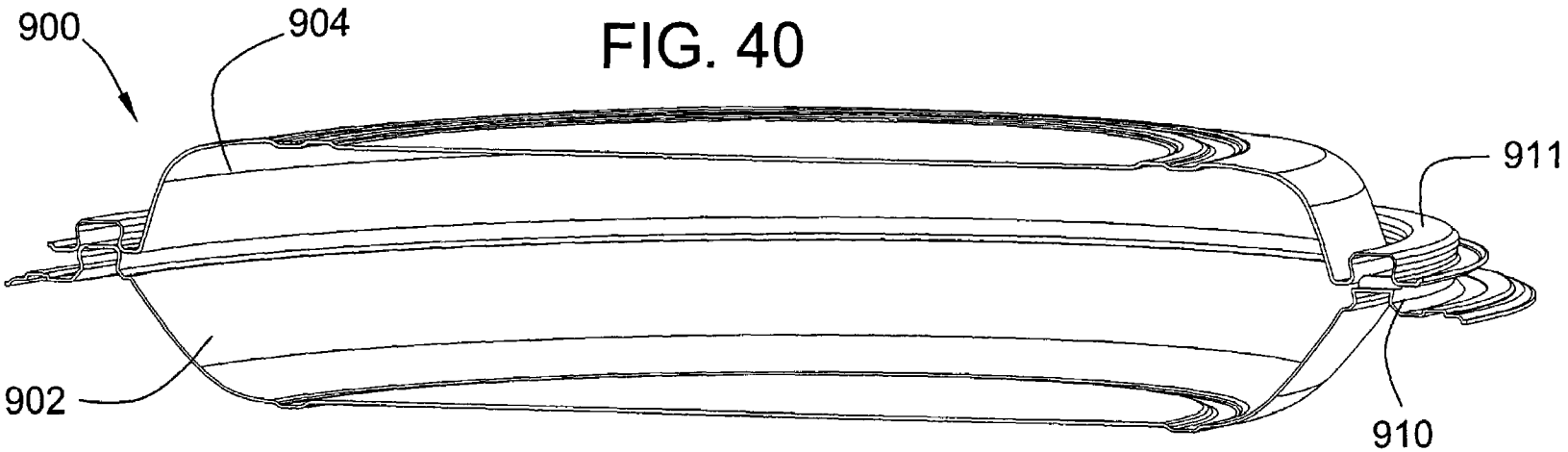
FIG. 40 is a fragmentary, perspective view, in section, of the container of FIG. 38.

Referring to FIG. 37, first and second closure portions 810, 811 are in the occluded position, forming a seal therebetween. The air passageways 881, 883 are closed. The inner and outer walls 860, 864 of the first closure portion 810 respectively cooperate with inner and outer walls 861, 865 of the second closure portion 811 to provide a pair of seals 885, 887 therebetween.

The container 800 is similar in other respects to the container 100 shown in FIG. 1.

Figure 39:
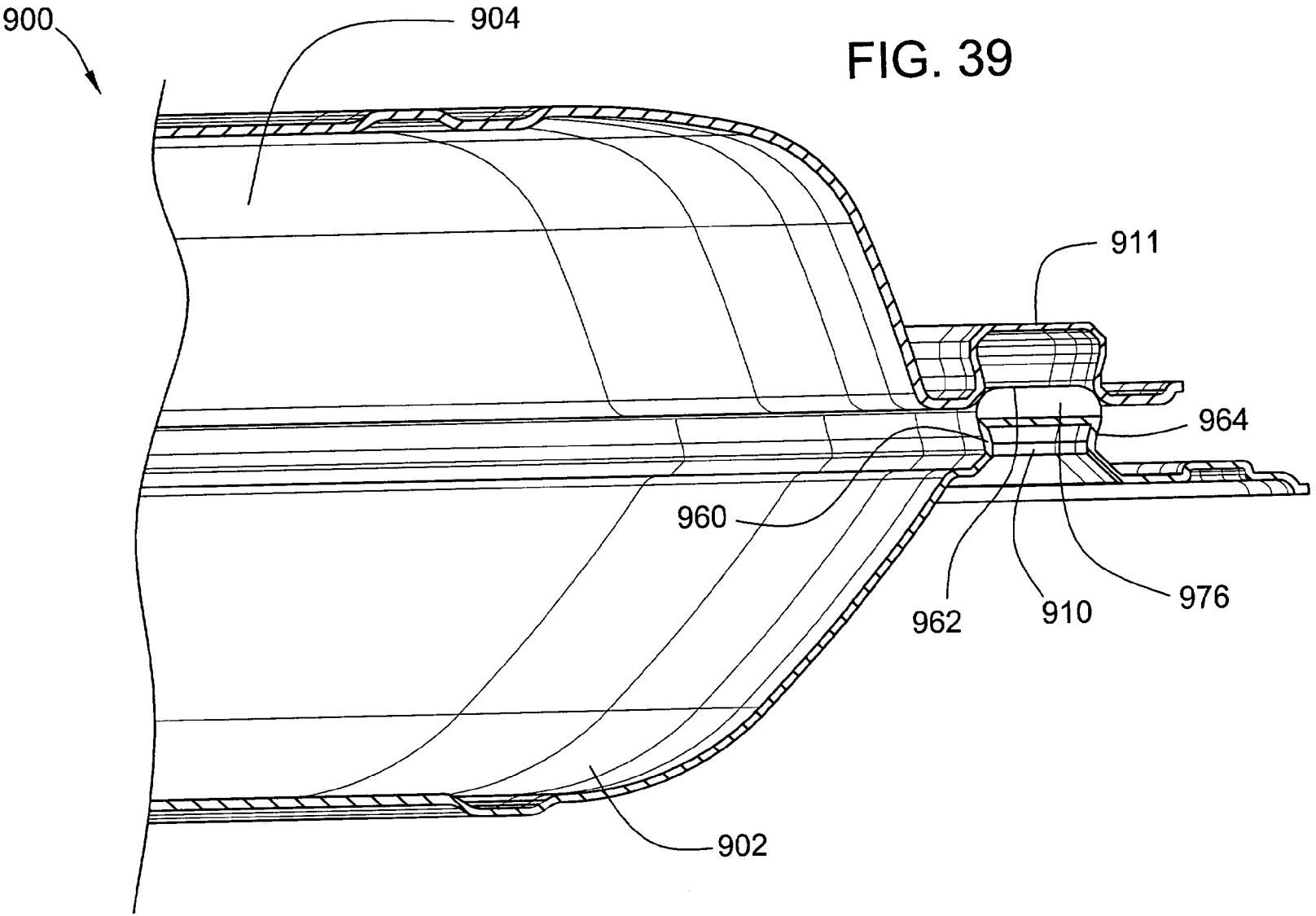
FIG. 39 is an enlarged, detail view taken from FIG. 38.
Figure 41:
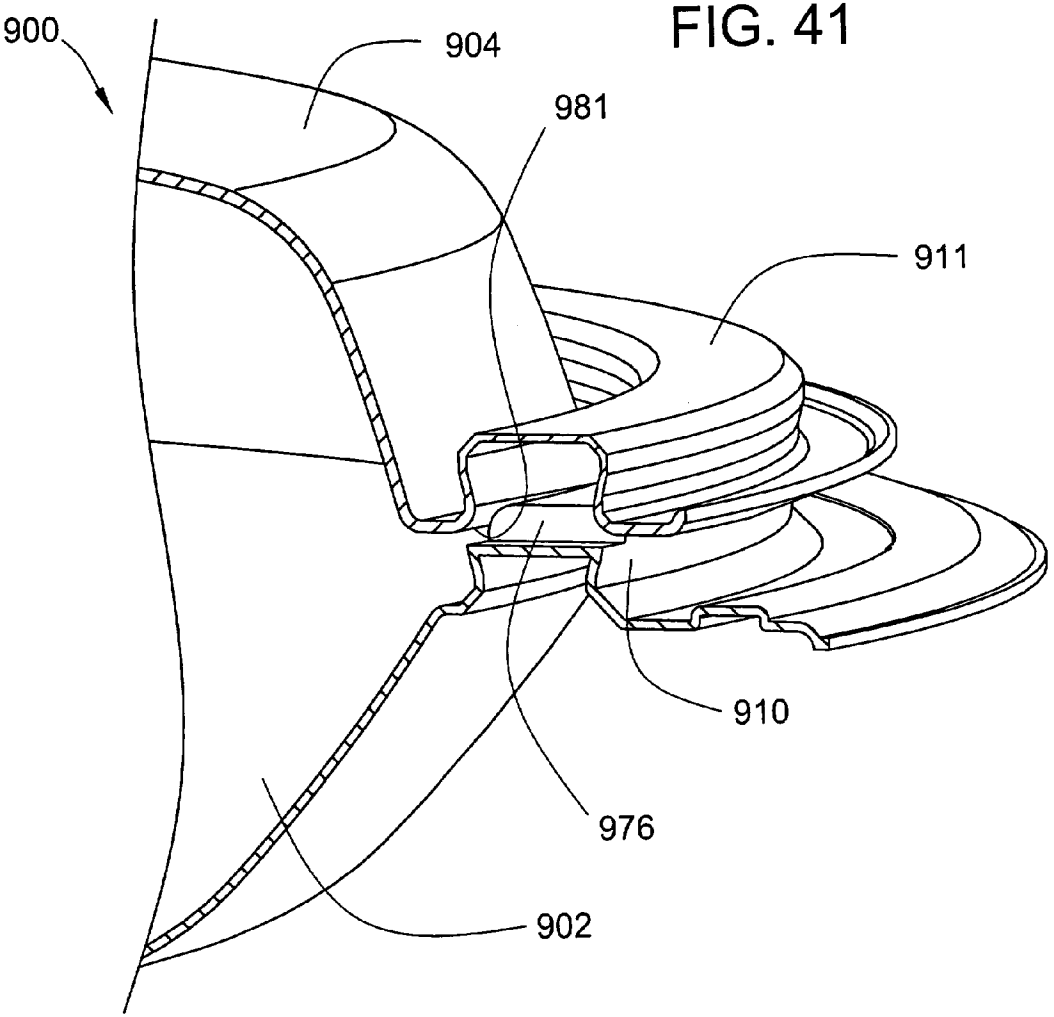
FIG. 41 is an enlarged, detail view taken from FIG. 40.
Figure 42:
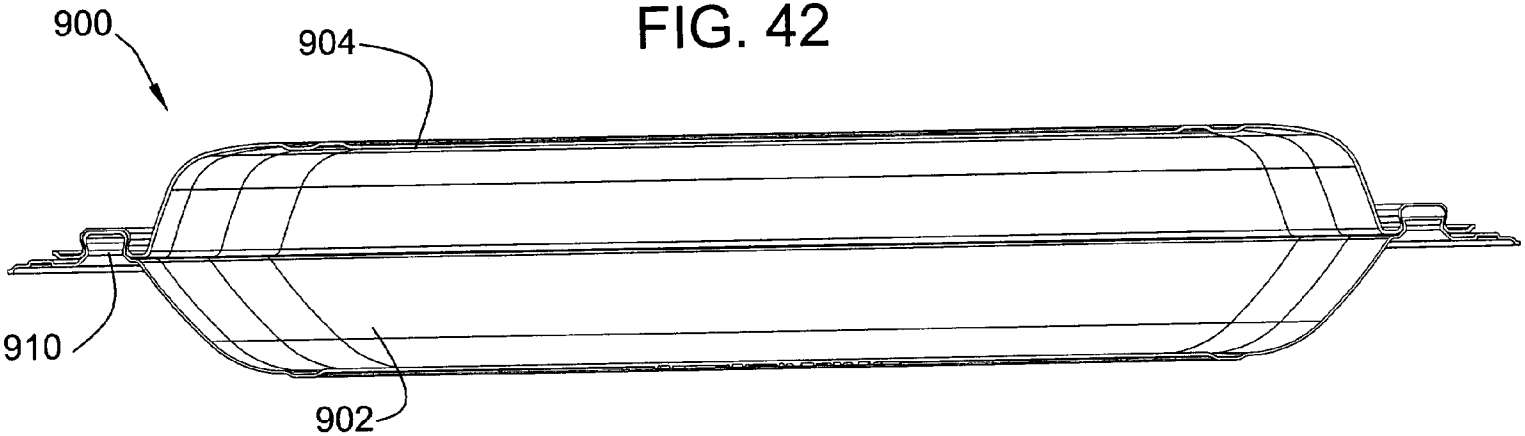
FIG. 42 is a cross-sectional view similar to FIG. 38, showing the cover and the bottom in an occluded position.
Figure 44:
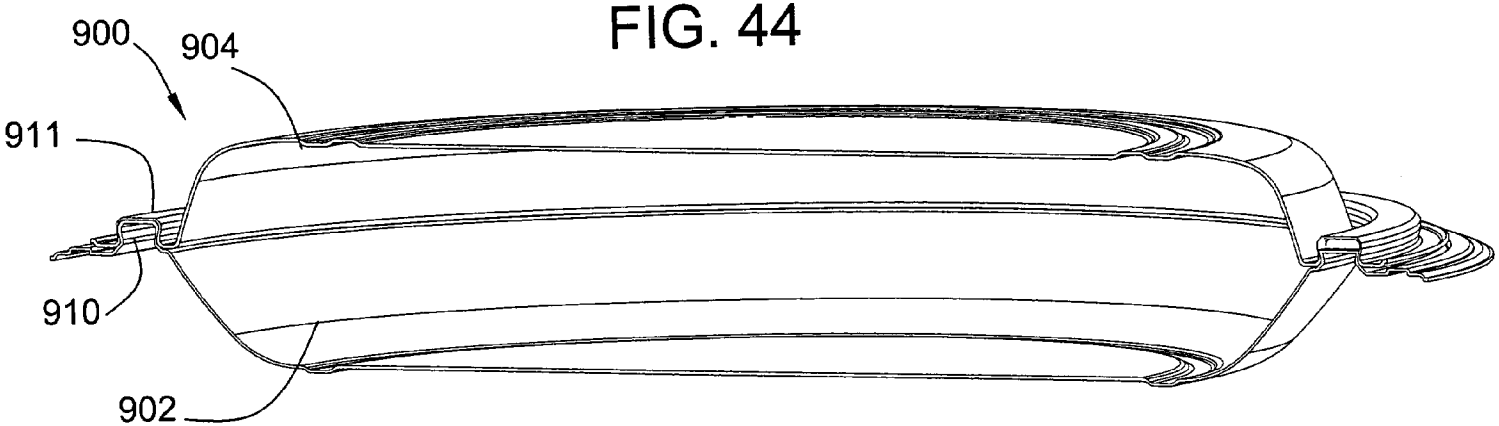
FIG. 44 is a fragmentary, perspective view, in section, of the container of FIG. 42.

Referring to FIGS. 38–45, another embodiment of a container 900 is shown. The container 900 includes a base 902 and a cover 904, which have a first and second closure portion 910, 911, respectively. Referring to FIG. 39, the first closure portion includes an inner wall 960, a retention bead 962 and an outer wall 964. The first closure portion 910 includes a notch 976 in the form of a groove that extends from the inner wall 960 to the outer wall 964. Referring to FIG. 41, the notch 976 of the first closure portion 910 cooperates with the second closure portion 911 to define an air passageway 981 for venting the storage area of the container 900 during the occlusion of the cover 904 and the base 902.

Figure 43:
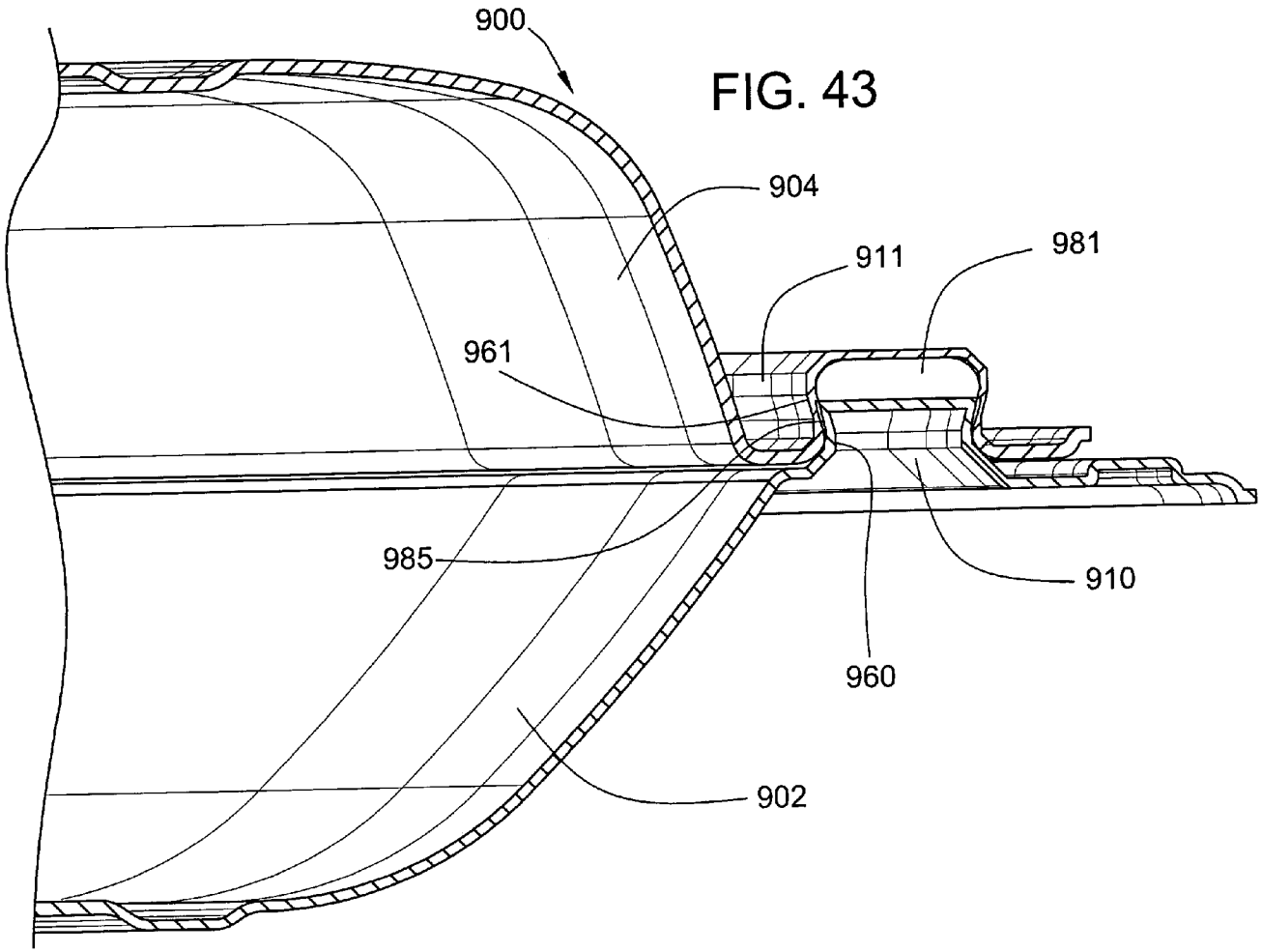
FIG. 43 is an enlarged, detail view taken from FIG. 42.
Figure 45:
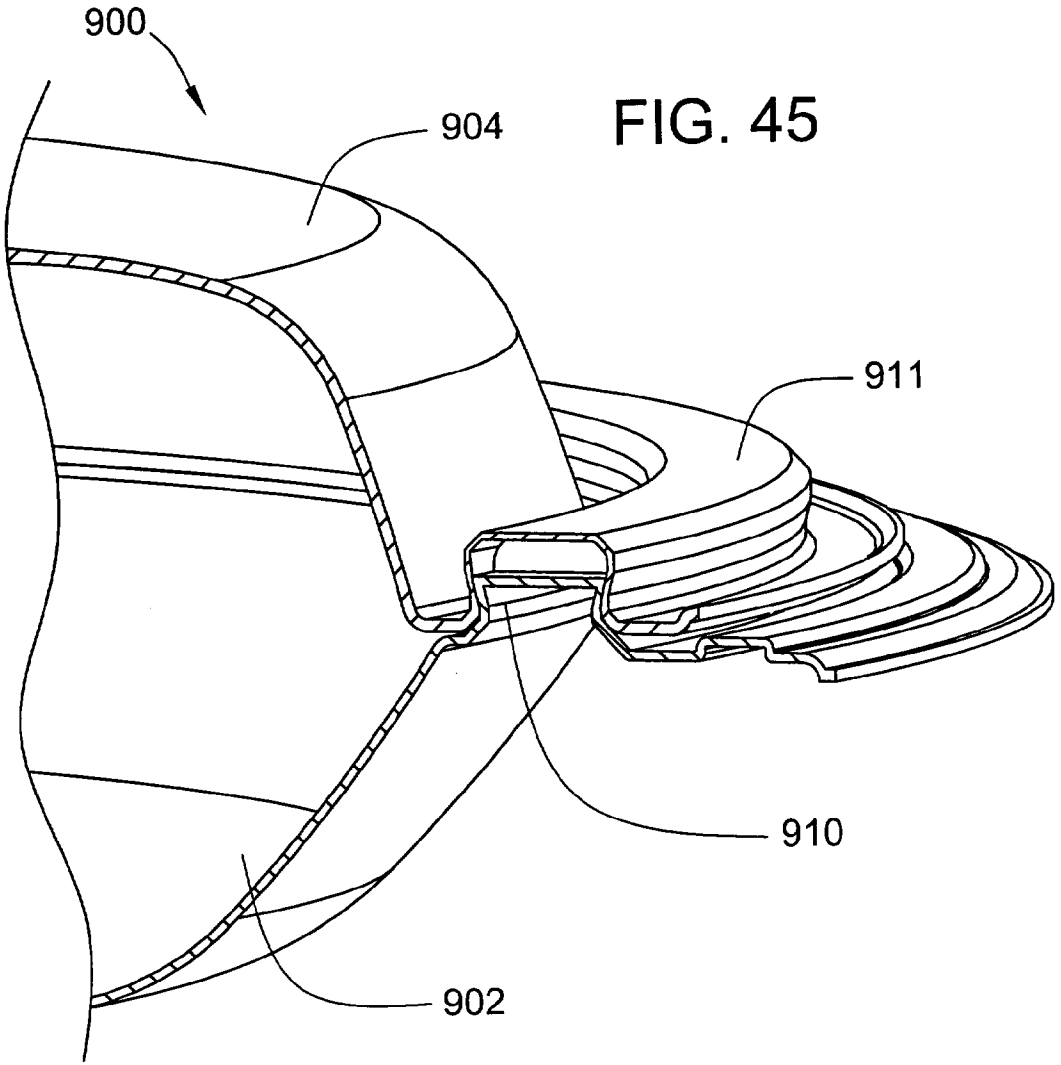
FIG. 45 is an enlarged, detail view taken from FIG. 44.

Referring to FIG. 43, the first and second closure portions 910, 911 are occluded to seal the container 900. The air passageway 981 is closed. The inner wall 960 of the first closure portion 910 cooperates with an inner wall 961 of the second closure portion 911 to provide a seal 985.

The container 900 is similar in other respects to the container 100 shown in FIG. 1.

Figure 46:
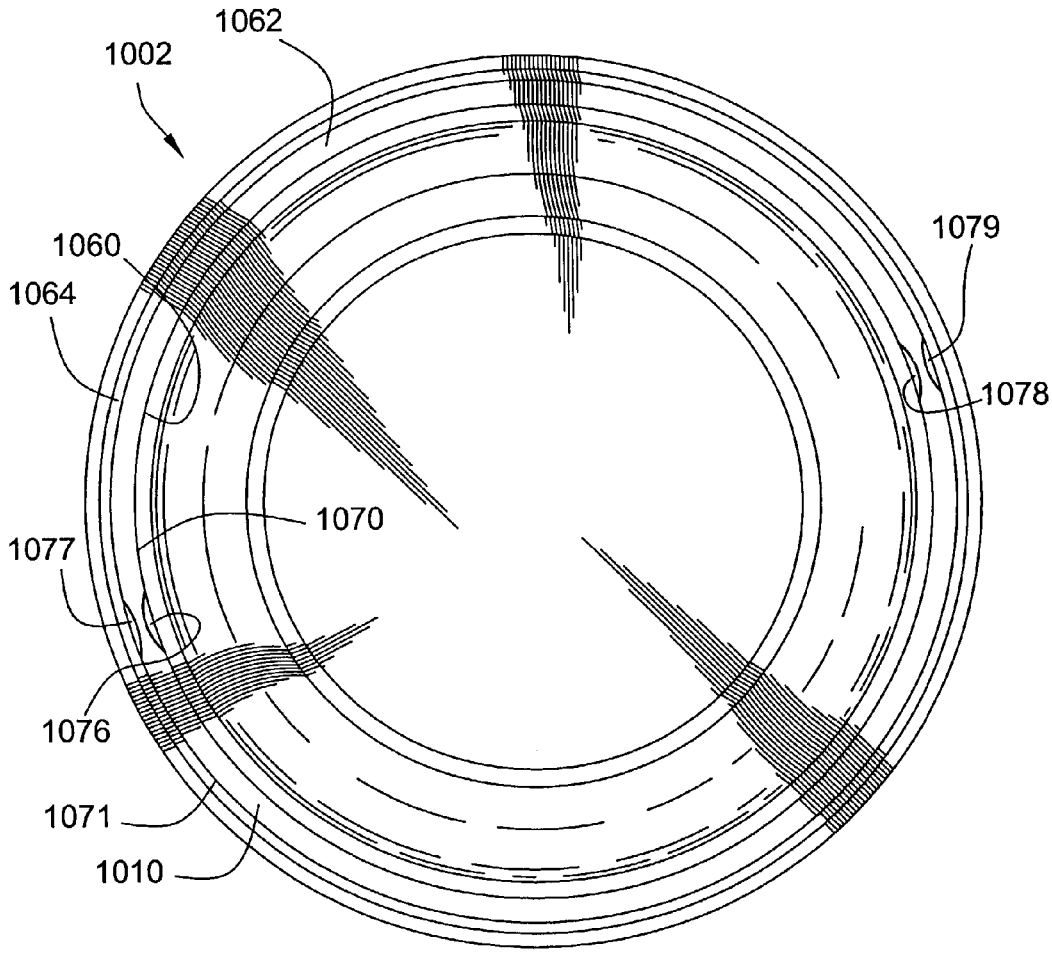
FIG. 46 is a top plan view of another embodiment of a base suitable for use with the cover of FIG. 13.

Referring to FIG. 46, another embodiment of a base 1002 is shown. The base 1002 can be used with any suitable cover, such as the cover 104 shown in FIG. 1, to provide an enclosed storage area. The base 1002 includes a first closure portion 1010 in the form of a raised locking ring. The first closure portion 1010 includes an inner wall 1060, a retention bead 1062, and an outer wall 1064. The retention bead 1062 includes first and second shoulders 1070, 1071. The first closure portion 1010 includes first and second notches 1076, 1077 that define air passageways between the base 1002 and the cover while the closure portions of the base and the cover undergo an occlusion sequence. The first and second notches 1076, 1077 are disposed on the shoulders 1070, 1071, respectively, adjacent the inner and outer walls 1060, 1064, respectively. The first and second notches 1076, 1077 are substantially aligned with, and in opposing relation to, each other. The base 1002 includes a third and a fourth notch 1078, 1079 which are disposed in opposing relation to the first and second notches 1076, 1077 on the closure portion 1010. The third and fourth notches 1078, 1079 are disposed 180° apart from the first and second notches 1076, 1077 along the first closure portion 1010. The third and fourth notches 1078, 1079 are disposed on the first and second shoulders 1070, 1071 adjacent the inner and the outer walls 1060, 1064, respectively. The third and fourth notches 1078, 1079 are substantially aligned with, and in opposing relation to, each other. The third and fourth notches 1078, 1079 can cooperate with the closure portion of the cover to define a pair of passageways for venting the storage area defined by the base and the cover during the occlusion sequence thereof.

Figure 47:
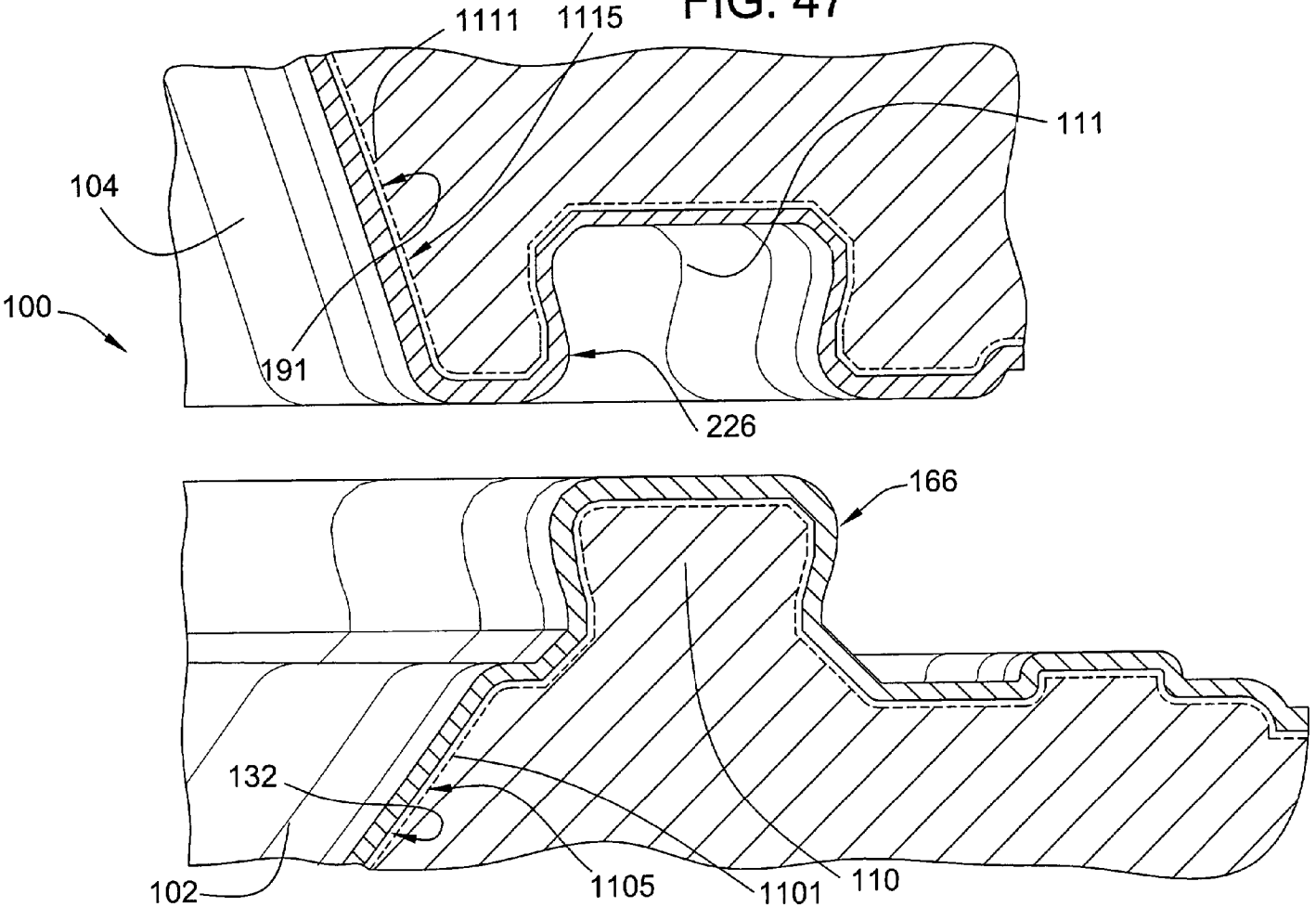
FIG. 47 is a partial, cross-sectional view of the container of FIG. 1, showing the manufacture thereof.

Referring to FIG. 47, both the container base 102 and the container cover 104 can be made of a plastic material. The cover and the base can be made by a thermoforming process, for example, such that the first and second sealing surfaces 166, 226 are molded without contacting the respective mold tool surface during manufacture thereof.

In one method for making the container 100, a base mold 1101 can be provided. By way of illustration, the space which the base mold 1101 can occupy during manufacture of the base 102 is shown by a cross-hatch region 1101 in FIG. 46. The base mold 1101 includes a base mold tool surface 1105 configured to define the base 102. The base mold tool surface 1105 is configured such that the exterior surface 132 of the base 102 is in contact with the base mold tool surface 1105. The first sealing surface 166 of the first closure portion 110 can be made without contacting the base mold tool surface 1105 during the manufacture thereof. The base 102 can be molded by conventional thermoforming techniques.

A cover mold 1111 can be provided. By way of illustration, the space which the cover mold 1111 can occupy during manufacture of the cover 104 is shown by a second cross-hatch region 1111 in FIG. 46. The cover mold 1111 has a cover mold tool surface 1015 configured to define the cover 104. The cover mold tool surface 1115 can be configured such that the exterior surface 191 of the cover 104 is in contact with the cover mold tool surface 1115. The second sealing surface 226 of the second closure portion 111 can be molded without contacting the cover mold tool surface 1115 during the manufacture thereof. The cover 104 can be molded using conventional thermoforming techniques.

The selection of mold surfaces permits manufacture of the cover which otherwise may be impractical due to thermoforming considerations. In this instance, the cover mold 1111 is commonly referred to as a "female" mold owing to the dome 106 portion of the cover 104 being formed into a concavity on the tool surface. Use of a female mold is advantageous as compared to a "male" mold having a convexity in order to avoid overly-deep draw formation that may result in webbing. For instance, the channel 250 in FIG. 20 may be impractical to form with use of male tooling because of the high likelihood that webbing would occur due to the overly-deep draw in this area. With female tool manufacture, this concern is avoided. It is very advantageous to utilize a domed cover whereby the width 258 defined by the channel 250 in FIG. 20 is narrow. This is because the headspace of the container defined by the interior surface 190 is deleteriously reduced as the width 258 is made wider, assuming dimensions of the closure 111 remain constant. If a male tool were chosen to manufacture the cover 104, the width 258 would necessarily be wider to avoid webbing. As such, not only is container headspace compromised but also the cover's dual function of being inverted and itself used as a serving plate would be compromised owing to the coincident reduction in serving area defined by the interior surface 190. Furthermore, selection of a female tool to manufacture the cover 104 also permits use of reverse trim station configurations which are commonly employed on state-of-the-art thermoforming equipment.

The container can be made with conventional thermoforming equipment. The tools can be run on an in-line extrusion/forming process or on a roll-fed thermoforming process, for example.

The base and the cover can be fabricated by thermoforming a clarified polypropylene homopolymer material, such as the clarified polyprohomo with the trade name 3289M and sold by Fina Oil and Chemical Co. In another embodiment, the container may be fabricated by thermoforming a clarified random copolymer polypropylene material, such as Pro-fax SR-256M from Montell North America Inc., Wilmington, Del. Alternative plastic materials which would be suitable for fabricating the container by thermoforming include PS (polystyrene), CPET (crystalline polyethylene terephthalate), APET (amorphous polyethylene terephthalate), HDPE (high density polyethylene), PVC polyvinyl chloride), and PC (polycarbonate), for example.

The base and the cover can be made from a generally transparent material to allow a user to view the inside of the container to view its contents. The container can be constructed from a material that is suitable for use in conventional freezers and microwave ovens and that is dishwasher-safe.

The cover can be configured such that it is different from the base to facilitate the ready identification of the two components from each other. The base of the container can be made from a homopolymer polypropylene material, for example with a color tinting added thereto, such as blue, for example. The cover can be made from a homopolymer polypropylene, for example, which can be untinted to facilitate differentiation between the base and the cover.

The container may include only one notch for venting or may include a plurality of notches in spaced relationship to each other around the perimeter. The container from a top plan view may be circular, elliptic, or generally rectangular.

The container may include additional features. For example, the container top and/or the container bottom may have an area which allows the user to write information, such as, the date. The write-on area could be an opaque color, such as, an opaque white, which would receive a contrasting color from a writing instrument, such as, a marker with black ink. The write-on area could be incorporated into the material for the container or could be applied to the material, such as, by printing.

The container may also include a visual indication of closure between the container top and the container bottom. The visual indication may be a color change in the area where the container top engages the container bottom. In one embodiment, the closure device on the container top may be a first color, such as, a translucent blue and the closure device on the container bottom may be a second color, such as, an opaque yellow. When the closure devices are occluded, the first and second colors produce a third color, such as, a green which is visible to the user to indicate that the container is sealed. Alternatively, the color change can result from the appearance or loss of a color as a result of hindrance by the closure portions. Examples of color change closures and techniques for forming a color change seal are shown in U.S. Pat. Nos. 4,186,786, 4,285,105, 4,829,641, 4,907,321, 5,248,201, 5,356,222, 5,252,281 and 5,427,266 which are incorporated herein by reference.

The colors may be incorporated into the material for the container or a portion of the container, such as in the closure area, or the colors may be applied to the material, such as, by printing. The actual inclusion of a color change closure or visual indication closure can be effected by use of established commercially available techniques. For example, if the lid and tub are to have a different color at the interface where the lid attaches to the tub the two respective surfaces can be fashioned with a color or design by use of screen printing (also known as silk-screen printing), pad printing (also known as transfer pad printing) or ink jet printing. The printing may be performed on the unformed material or the printing may be performed on the formed container. In addition, other approaches for forming a color or pattern on the lid and tub surfaces where such mate includes the use of co-extruded sheet material which is then thermoformed. The aforementioned techniques are well known for use in providing decorative surfaces to plastic surfaces.

Furthermore, the colors may be incorporated into the material by using in-mold labeling during the thermoforming process. The process for in-mold labeling for thermoforming involves the following steps. The label, such as an opaque yellow label, is positioned in a predetermined location on the thermoforming cavity for the part. The plastic is then positioned over the label and over the thermoforming cavity. The part is then formed and the label is embedded into the part. As an example, the closure device on the container top may include a translucent blue in-mold label and the closure device on the container bottom may be an opaque yellow in-mold label. When the closure devices are occluded, the in-mold labels produce green which is visible to the user to indicate that the container is sealed.

The container may also include an audible indication of closure or a tactile indication of closure. In one embodiment, the closure device on the container top includes interior protrusions which engage exterior detents on the closure device on the container bottom. When the closure devices are engaging, the closure devices will make a clicking sound and cause a vibration in the container which is perceptible to the user to indicate that the container is sealed. Examples of audible closures and/or tactile closures disclosing techniques to provide this functionality are shown in U.S. Pat. Nos. 4,944,072, 5,070,584, 5,138,750, 5,140,727, 5,154,086, 5,363,540, 5,403,094 and published European applications EP A 90314084.5 and EP A 92301996.2 which are incorporated herein by reference.

The container may also include a rough exterior surface to reduce slipping and improve grasping by the user. For example, the exterior of the container bottom may have a textured surface, as opposed to a smooth surface, to improve handling by the user, especially if the user's hands are wet or greasy.

In addition, the container may include a self-venting feature. The pressure in the sealed container may increase when the sealed container and contents are heated in a microwave oven. Thus the container top may include a self-venting mechanism which opens when the pressure in the container exceeds a predetermined value.

The container bottom may include a peelable lid with a super seal. Specifically, in a commercial use, the container bottom may include an interior peelable lid which is glued to the closure device.

In another embodiment, the peelable lid would release or vent when the sealed container and contents are heated in a microwave oven. Specifically, the heat would weaken the glue and allow the pressure to escape and/or the glue would be the weakest point of the container and allow the pressure to escape.

The container may be divided to separate various foods in the container. The divider would permit the user to store one food in one compartment and another food in another compartment. The divider may be integral with the container or a separate component. In addition, only the container bottom may include a divider or both the container bottom and the container top may each include a divider. The divider located in the container top may only partially engage the divider in the bottom of the container so as to provide splash protection or may fully engage the divider in the bottom of the container so as to provide varying degrees of inter-compartmental leak resistance. The container may be compartmented by use of a separate smaller container that can be disposed within the main container such that the smaller container is securedly maintained by a locating means or fastening means. The smaller container may be lidded or may utilize the container cover as a lid.

The container may also include a temperature-indicating strip which would indicate the temperature of the container and contents. In one embodiment, the temperature strip could indicate the approximate temperature of the container and contents. In another embodiment, the temperature strip could indicate whether the container and content are within one of several temperature ranges. In a third embodiment, the temperature strip could indicate whether the container and contents are either hot or cold.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a base, the base having a plate-like configuration, the base having an exterior surface and an interior surface, the base including a first closure portion and a first stacking element extending from the exterior surface, wherein the first closure portion includes an inner wall, a retention bead, and an outer wall, the retention bead between the inner and the outer walls, the inner and outer walls joined to the retention bead at an inner and an outer shoulder, respectively, the inner wall and the outer wall in converging relationship with each other; and a cover, the cover having an interior surface and an exterior surface, the cover including a dome portion, a second closure portion and a second stacking element, the interior surface of the dome portion being substantially concave, the second closure portion being adapted for scaling engagement with the first closure portion of the base so that when the first and second closure portions are engaged with each other, the cover and the base define a substantially sealed storage area;

wherein the base is disposable in the interior of the dome portion of the cover such that a portion of the exterior surface of the base is in contact with a portion of the interior surface of the cover and the first stacking element is engaged with the second stacking element.

2. The container as described in claim 1 wherein said first closure portion has a first visual indicator element comprising a first color; and wherein said second closure portion has a second visual indicator element comprising a second color;

wherein when the first and second closure portions are engaged with each other, the first and second visual indicator elements including the first and second colors cooperate with each other to provide a third color indicating closure of the cover upon the base.

3. The container as described in claim 2 wherein the first color is translucent blue, the second color is opaque yellow, and the third color is green.

4. The container as described in claim 2 wherein the first visual indicator element includes a first pattern applied to the first closure portion, the second visual indicator element includes a second pattern applied to the second closure portion, and when the first closure portion engages the second closure portion, the first pattern and the second pattern cooperate to produce a third pattern.

5. The container as described in claim 2 wherein the first closure portion includes an inner wall, a retention bead, and an outer wall, the retention bead between the inner and the outer walls, the inner and outer walls joined to the retention bead at an inner and an outer shoulder, respectively, the inner wall and the outer wall in converging relationship with each other.

6. The container as described in claim 5 wherein the second closure portion includes an inner wall, a retention bead, and an outer wall, the retention bead between the inner and the outer walls, the inner and outer walls joined to the retention bead at an inner and an outer shoulder, respectively, the inner wall and the outer wall in converging relationship with each other, and the second closure portion being relatively larger than the first closure portion.

7. The container as described in claim 1 wherein the second closure portion includes an inner wall, a retention bead, and an outer wall, the retention bead between the inner and the outer walls, the inner and outer walls joined to the retention bead at an inner and an outer shoulder, respectively, the inner wall and the outer wall in converging relationship with each other, and the second closure portion being relatively larger than the first closure portion.

8. The container as described in claim 7 wherein the cover includes a pair of nest lugs, the nest lugs being disposed in opposing relation to each other adjacent the inner and outer walls of the first closure portion, respectively, and the nest lugs engageable with the shoulders of a second cover when the second cover is stacked upon the first cover.

9. The container as described in claim 1 wherein the base has a material wall thickness of about 0.010 inches to about 0.050 inches.

10. The container as described in claim 1 wherein the cover has a material wall thickness of about 0.010 inches to about 0.050 inches.

11. The container as described in claim 1 wherein said container is made by a thermoforming process.

12. The container as described in claim 1 wherein the first stacking element is in the form of a ring.

13. A container comprising:

a base, the base having a plate-like configuration, the base including a substantially planer bottom wall portion and a side wall portion extending upwardly and outwardly from the bottom wall portion and joined to a peripheral first closure portion and a flange, the first closure portion including an inner wall, an outer wall, and a retention bead between the inner and outer walls, the inner and outer walls joined to the retention bead at an inner and outer shoulder, respectively, the inner and outer walls in a converging relationship with each other, the flange extending from the first closure portion and defining a perimeter of the base, the flange being resiliently flexible;

a cover, the cover including a second closure portion having at least one gripping tab, the second closure portion adapted for sealing engagement with the first closure portion of the base so that when the first and second closure portions are occluded, the cover and the base define a substantially sealed storage area;

wherein when the first and second closure portions are sealingly engaged, the flange of the base is closely adjacent the cover, the flange of the base capable of being flexed away from the cover to facilitate the removal of the cover from the base; and wherein the base includes a third shoulder and a pair of nest lugs, including a first inner nest lug and a second outer nest lug, the third shoulder is disposed between the first inner nest lug and the side wall the nest lugs being disposed in opposing relation to each other adjacent the inner and outer walls of the first closure portion, respectively, the first inner nest lug extends upwardly and outwardly from the third shoulder at an oblique angle thereto and merges into the inner wall, the second outer nest lug extends outwardly and downwardly from the outer wall, and the nest lugs engageable with the shoulders of a second base when the first base is stacked upon the second base.

14. The container as described in claim 13 wherein the second closure portion includes an inner wall, a retention bead, and an outer wall, the retention bead between the inner and the outer walls, the inner and outer walls joined to the retention bead at an inner and an outer shoulder, respectively, the inner wall and the outer wall in converging relationship with each other, and the second closure portion being relatively larger than the first closure portion.

15. The container as described in claim 14 wherein the cover includes a pair of nest lugs, the nest lugs being disposed in opposing relation to each other adjacent the inner and outer walls of the first closure portion, respectively, and the nest lugs engageable with the shoulders of a second cover when the second cover is stacked upon the first cover.

16. The container as described in claim 13 wherein the gripping tab is reinforced.

17. The container as described in claim 16 wherein the gripping tab is reinforced by a rib, and the rib provides a stiffening effect and leverage in separating the cover from the base.

18. The container as described in claim 13 wherein the base includes a first stacking element, the cover includes a second stacking element, and the first stacking element of a first container engages the second stacking element of a second container when said first container is stacked upon said second container.

19. The container as described in claim 18, wherein the second stacking element extends from the interior surface.

20. The container as described in claim 19 wherein the second stacking element is in the form of a ring.

21. The container as described in claim 12 wherein the first and second stacking elements are complementary such that the first stacking element can be accepted by the second stacking element to assist in stacking multiple containers.

22. The container as described in claim 13 wherein the base has a material wall thickness of about 0.010 inches to about 0.050 inches.

23. The container as described in claim 13 wherein the cover has a material wall thickness of about 0.010 inches to about 0.050 inches.

24. The container as described in claim 13 wherein said container is made by a thermoforming process.

25. A container comprising:

a base, the base having a plate-like configuration, the base having an exterior surface and an interior surface, the base including a first closure portion and a first stacking element extending from the exterior surface; and a cover, the cover having an interior surface and an exterior surface, the cover including a dome portion, a second closure portion and a second stacking element, the interior surface of the dome portion being substantially concave, the second closure portion being adapted for sealing engagement with the first closure portion of the base so that when the first and second closure portions are engaged with each other, the cover and the base define a substantially sealed storage area;

wherein the base is disposable in the interior of the dome portion of the cover such that a portion of the exterior surface of the base is in contact with a portion of the interior surface of the cover and the first stacking element is engaged with the second stacking element, wherein the base includes a pair of nest lugs, the nest lugs being disposed in opposing relation to each other adjacent the inner and outer walls of the first closure portion, respectively, and the nest lugs engageable with the shoulders of a second base when the first base is stacked upon the second base.

26. A container comprising:

a base, the base having a plate-like configuration, the base having an exterior surface and an interior surface, the base including a first closure portion and a first stacking element extending from the exterior surface;

a cover, the cover having an interior surface and an exterior surface, the cover including a dome portion, a second closure portion and a second stacking element, the interior surface of the dome portion being substantially concave, the second closure portion includes an inner wall, a retention bead, and an outer wall, the retention bead between the inner and the outer walls, the inner and outer walls joined to the retention bead at an inner and an outer shoulder, respectively, the inner wall and the outer wall in converging relationship with each other, the second closure portion being adapted for sealing engagement with the first closure portion of the base so that when the first and second closure portions are engaged with each other, the cover and the base define a substantially sealed storage area; and wherein the base is disposable in the interior of the dome portion of the cover such that a portion of the exterior surface of the base is in contact with a portion of the interior surface of the cover and the first stacking element is engaged with the second stacking element.

27. The container as described in claim 26, wherein the cover includes a gripping tab, the gripping tab joined to the second closure portion.

28. The container as described in claim 27 wherein the gripping tab is reinforced.

29. The container as described in claim 28 wherein the gripping tab is reinforced by a rib, and the rib provides a stiffening effect and leverage in separating the cover from the base.

* * * * *